US006289823B1

(12) United States Patent
Koefelda et al.

(10) Patent No.: US 6,289,823 B1
(45) Date of Patent: Sep. 18, 2001

(54) NESTABLE PALLET

(75) Inventors: Gerald R. Koefelda, Hermosa Beach, CA (US); William P. Apps, Alpharetta, GA (US); Roger S. Hsu, Torrance, CA (US); Cyril J. Balfe, Lawrenceville, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/376,883

(22) Filed: Aug. 18, 1999

(51) Int. Cl.[7] ..... B65D 19/38
(52) U.S. Cl. ..... 108/53.3
(58) Field of Search ..... 108/53.3, 53.5, 108/53.1, 57.25, 57.28, 51.11

(56) References Cited

U.S. PATENT DOCUMENTS

| | | | | |
|---|---|---|---|---|
| Re. 32,344 | | 2/1987 | Wind . | |
| D. 388,931 | | 1/1998 | Constantino et al. . | |
| D. 400,682 | | 11/1998 | Constantino et al. . | |
| 3,526,195 | * | 9/1970 | Maryonovich | 108/53.3 X |
| 3,641,949 | * | 2/1972 | Monk | 108/53.3 |
| 4,199,164 | | 4/1980 | Sjoblom . | |
| 4,263,855 | | 4/1981 | Lawlor . | |
| 4,413,737 | | 11/1983 | Wind . | |
| 4,480,748 | | 11/1984 | Wind . | |
| 4,619,207 | | 10/1986 | Boyce et al. . | |
| 4,838,176 | | 6/1989 | Bowser, Sr. et al. . | |
| 4,879,956 | | 11/1989 | Shuert . | |
| 5,407,632 | | 4/1995 | Constantino et al. . | |
| 5,413,224 | | 5/1995 | Marron et al. . | |
| 5,606,921 | | 3/1997 | Elder et al. . | |
| 5,638,760 | | 6/1997 | Jordan et al. . | |
| 5,647,284 | | 7/1997 | Frysinger et al. . | |
| 5,669,315 | | 9/1997 | Model . | |
| 5,702,034 | | 12/1997 | Semenenko . | |
| 5,713,289 | | 2/1998 | Model . | |
| 5,730,067 | | 3/1998 | Kohlhaas . | |
| 5,758,855 | | 6/1998 | Jordan et al. . | |
| 5,813,355 | * | 9/1998 | Brown et al. | 108/53.3 |
| 5,819,941 | | 10/1998 | Vanwingerden . | |
| 5,829,361 | | 11/1998 | Fenton . | |
| 5,921,188 | | 7/1999 | Kohlhnaas . | |
| 5,941,178 | | 8/1999 | Kohlhaas . | |
| 5,950,545 | | 9/1999 | Shuert . | |
| 5,960,720 | | 10/1999 | Borland et al. . | |
| 5,964,162 | | 10/1999 | Chuan-Jen . | |

FOREIGN PATENT DOCUMENTS

| | | | | |
|---|---|---|---|---|
| 2043832 | * | 11/1971 | (DE) | 108/53.3 |
| 2610598 | * | 2/1987 | (FR) | 108/53.3 |
| 9002386 | * | 6/1991 | (NL) | 108/53.3 |

* cited by examiner

*Primary Examiner*—Jose V. Chen
(74) *Attorney, Agent, or Firm*—Brooks & Kushman P.C.

(57) ABSTRACT

A nestable pallet includes a top deck which has a substantially planar upper surface upon which a plurality of objects. The top deck has an upper surface and at least one opening formed therein. The pallet also includes a foot portion corresponding to the at least one opening. The foot portion has an inner surface, an outer surface, and an upright member which projects upwardly toward the top deck and has a hollow area disposed thereunder. In a nesting orientation, the hollow area receives the upward projecting member of a subjacent pallet. Preferably, the upper surface of the top deck portion is flat and substantially planar, upon which a plurality of objects are capable of resting. The opening, the inner surface and the upright member define a pocket for receiving the foot portion of a like pallet in a nesting orientation. In another embodiment, the pocket includes at least one aperture for drainage. In still another embodiment, the pocket includes at least one nesting stop portion.

24 Claims, 25 Drawing Sheets

Fig. 8
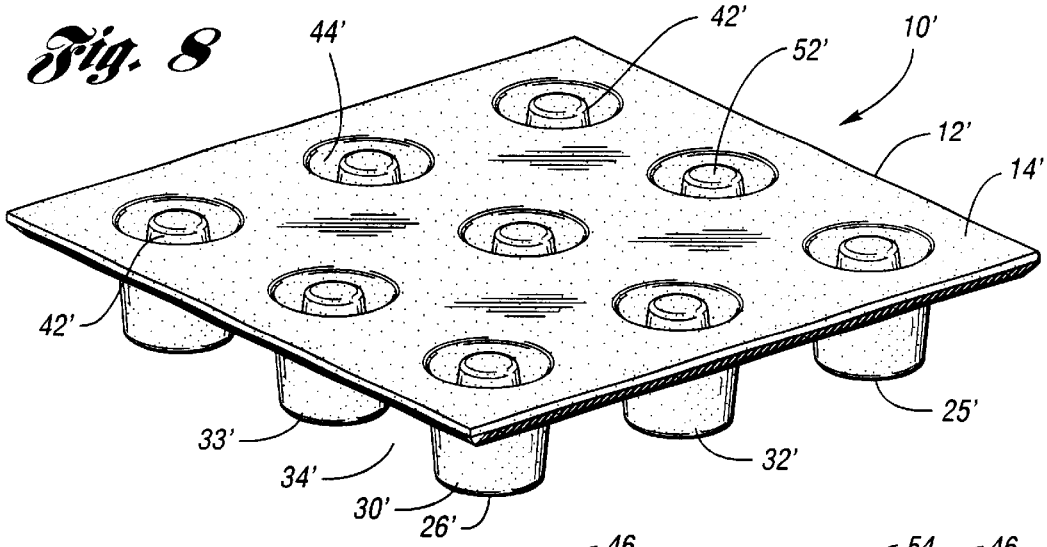
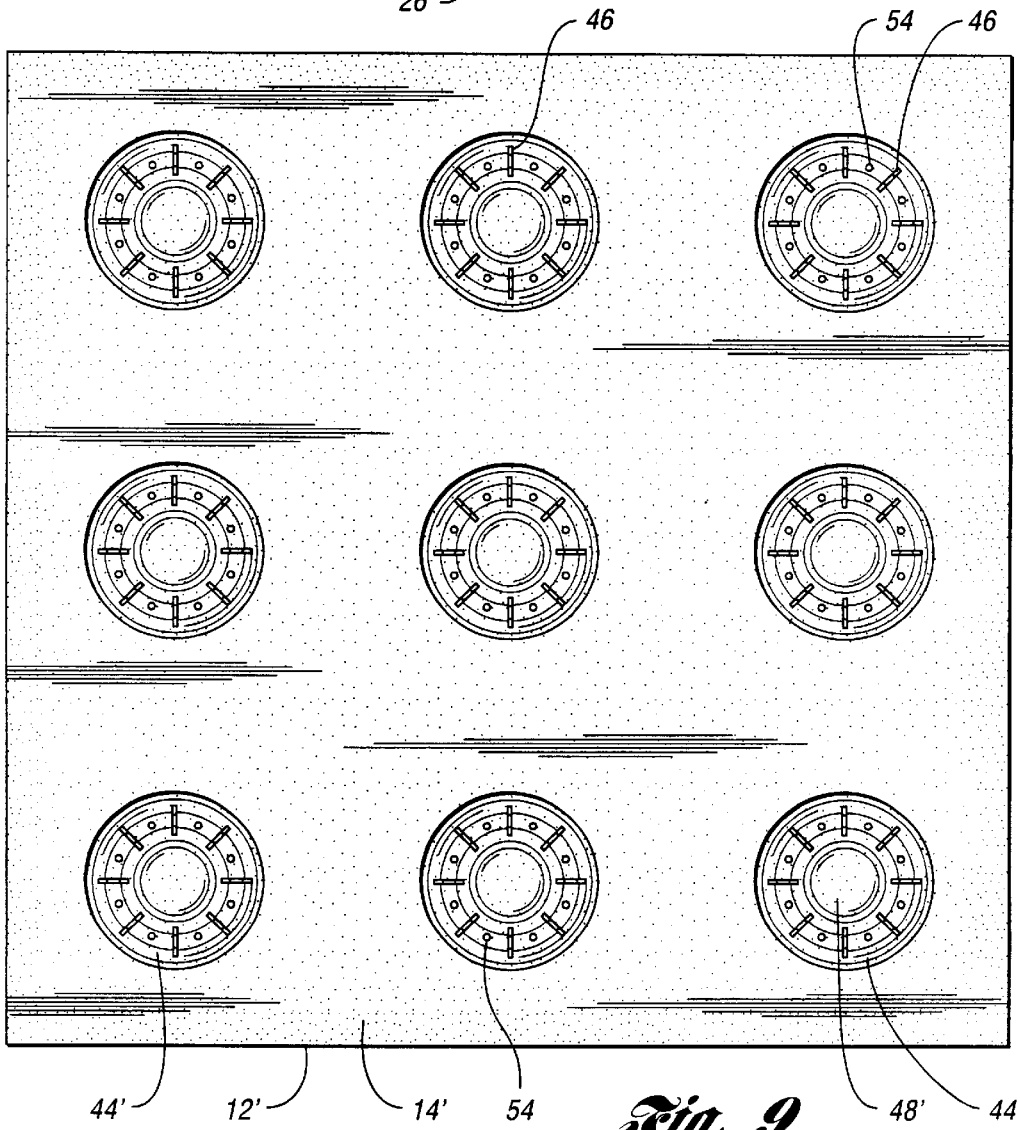
Fig. 9

NESTABLE PALLET

TECHNICAL FIELD

This invention relates to a nestable pallet for storing or transporting goods.

BACKGROUND ART

Pallets that nest together allow such pallets to be easily stored and transported when not in use. Nestable pallets used in industry today typically have openings in their upper surface which receive corresponding shaped feet of a similar nestable pallet. While these openings provide a means for nesting pallets together, there are also many disadvantages which accompany these openings. For example, current nestable pallet designs may not be used to ship products in bulk without a container because the product, depending on its size, may fully or partially fall into the upper surface openings. Even if a cardboard slip sheet is positioned between the product and the openings, under load the slip sheet is still weakest in the areas of the opening, particularly when such pallets are stacked upon each other during use. Thus, the weight and load of the upper pallets may cause the slip sheets to fail in these weakened areas, causing the product stacked on the lower pallets to push through the slip sheet and end up in the openings.

Thus, an improved pallet is desired which allows for ease and convenience of storage and transportation during non-use and which during use allows products to be safely and securely placed and transported thereon. The pallet should be reasonably inexpensive, lightweight and sturdy. The improved pallet 109 should also be easy to store.

DISCLOSURE OF INVENTION

It is a principal object according to the present invention to provide an improved pallet which is nestable during non-use periods such as when such pallets are stored and transported.

It is another object according to the present invention to provide a nestable pallet which allows for goods to be securely loaded thereon during use, and during the stacking of loaded pallets.

It is another object according to the present invention to provide a pallet which is relatively lightweight, inexpensive to manufacture and assemble, and consistently dimensioned.

It is yet another object according to the present invention to provide a pallet which may be stored, racked or stacked in a stable manner, thereby allowing one loaded pallet to be stacked on and supported by another loaded subjacent pallet.

In carrying out these and other objects and goals according to the present invention, a pallet is provided which includes a top deck which has a substantially planar upper surface upon which a plurality of objects and goods may be positioned during use. The pallet includes a top deck portion which has an upper surface and at least one opening formed therein. The pallet also includes a foot portion corresponding to the at least one opening. The foot portion has an inner surface, an outer surface, and an upright member which projects upwardly toward the top deck and has a hollow area disposed thereunder. In a nesting orientation, the hollow area receives the upward projecting member of a subjacent pallet. Preferably, the upper surface of the top deck portion is flat and substantially planar, upon which a plurality of objects are capable of resting. In one embodiment, the hollow area includes at least one nesting stop portion. The opening, the inner surface and the upright member define a pocket for receiving the foot portion of a like pallet in a nesting orientation. In another embodiment, the pocket includes at least one aperture for drainage. In still another embodiment, the pocket includes at least one nesting stop portion. The upper surface may also include a plurality of apertures for drainage.

In yet another embodiment of the pallet according to the present invention, a pallet is disclosed which is orientable in a nesting orientation with a like pallet. The pallet includes a plurality of cup-shaped support members. Each support member has an inner surface, an outer surface, and an opening. The support members further have an upright member which projects upwardly and defines a hollow area thereunder, such that the inner surface, opening and upright member together define a pocket therein. The pallet also includes a deck portion which has an upper surface with the openings of the support members formed therein for entry into the pocket. In the nesting orientation, the hollow area receives the upright member of a subjacent like pallet. In the nesting orientation, the pocket receives the support member of an above-positioned like pallet.

The above objects and other objects, features, and advantages of the present invention are readily apparent from the following detailed description of the best mode for carrying out the invention when taken in connection with the accompanying drawings wherein like reference numerals correspond to like components.

BRIEF DESCRIPTION OF DRAWINGS

FIG. 8 is a top perspective view of an alternate first embodiment design, being similar to the first embodiment but having no apertures through the top deck;

FIG. 9 is a top plan view of the alternate first embodiment of FIG. 8;

BEST MODE FOR CARRYING OUT THE INVENTION

Figure 1:
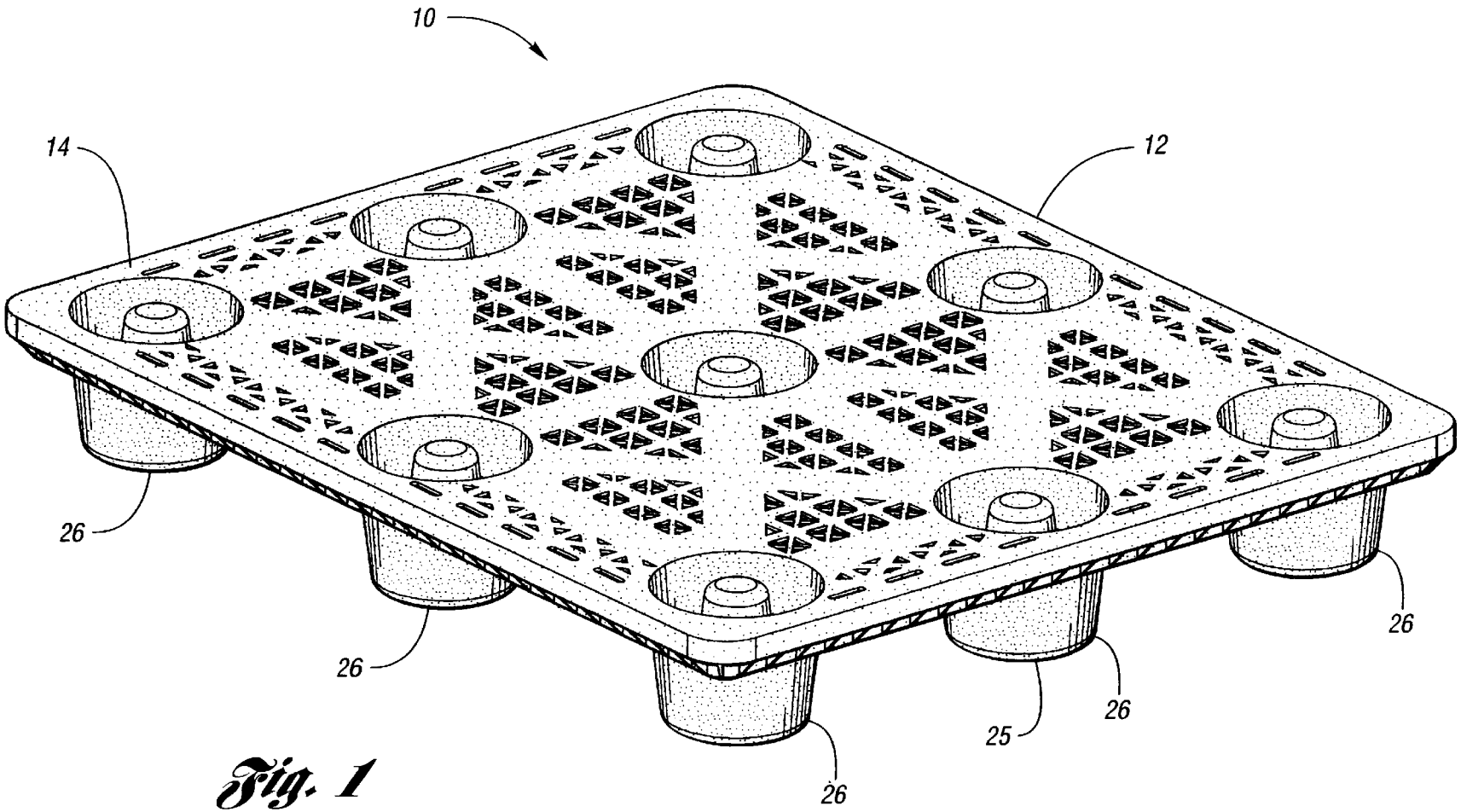
FIG. 1 is a top perspective view of a first embodiment of a nestable pallet according to the present invention.

FIG. 1 of the drawings shows a top perspective view of a first embodiment of a nestable pallet 10 according to the present invention. Pallet 10 (as well as subsequent embodiments disclosed herein according to the present invention) is preferably formed of a thermoplastic or other polymeric material and is preferably, but not necessarily, formed via an injection molding process. Engineered materials may be used, as well as a synthetic resin such as polyethylene or polypropylene with a filler added to stiffen the resin. Of course, it is fully contemplated that the pallet disclosed herein may be manufactured by various other molding techniques and manufacturing processes applicable to the design and material selected, including but not limited to blow molding, thermoforming, vacuum molding, etc. It is further contemplated that the material from which the pallet according to the present invention is formed may include materials other than plastics and polymer blends, and may include, by example and not limitation such other materials such as wood, corrugated paperboard, compressed sawdust, and metallic materials such as aluminum or tin.

Figure 2:
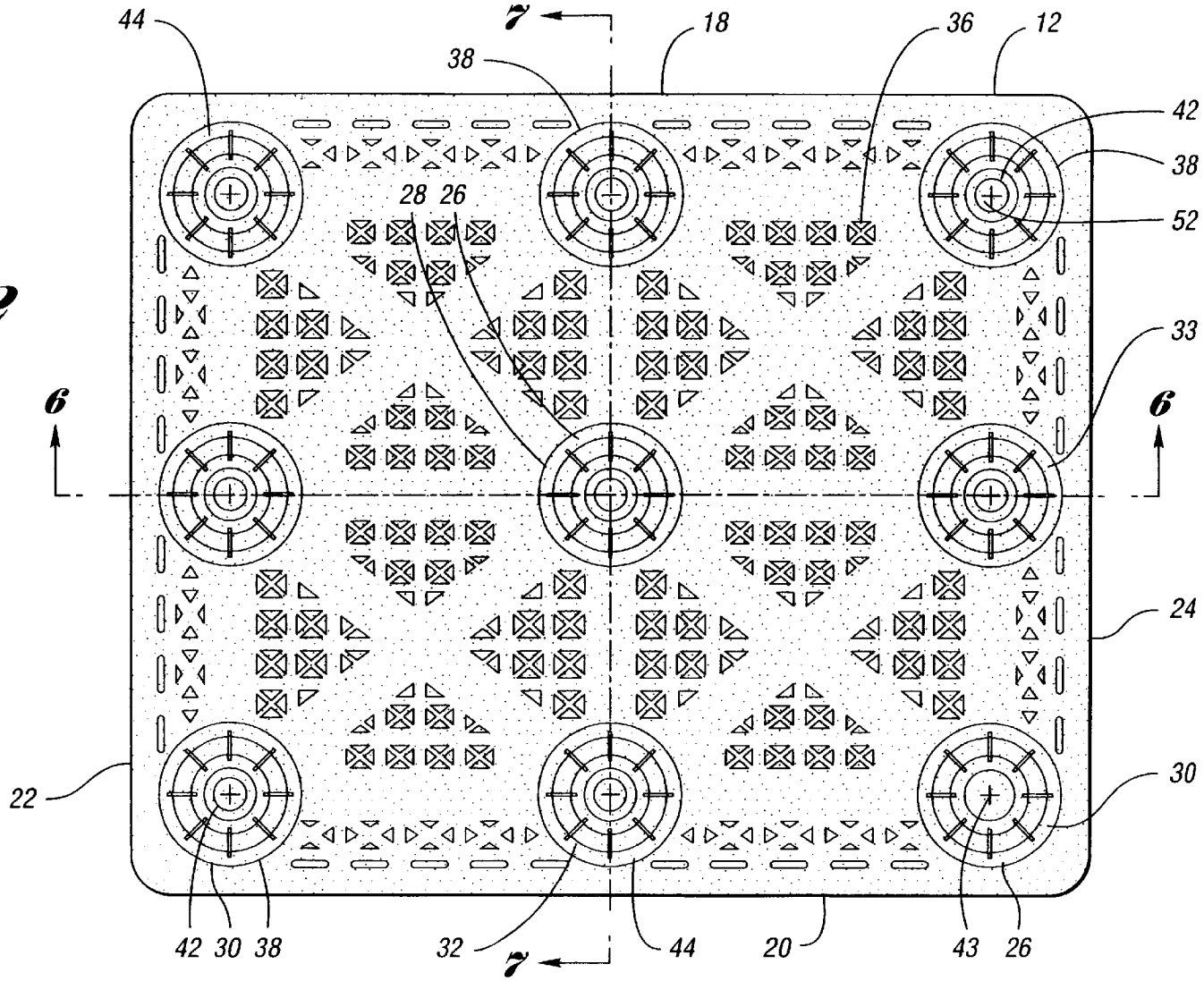
FIG. 2 is a top plan view of the first embodiment.
Figure 3:
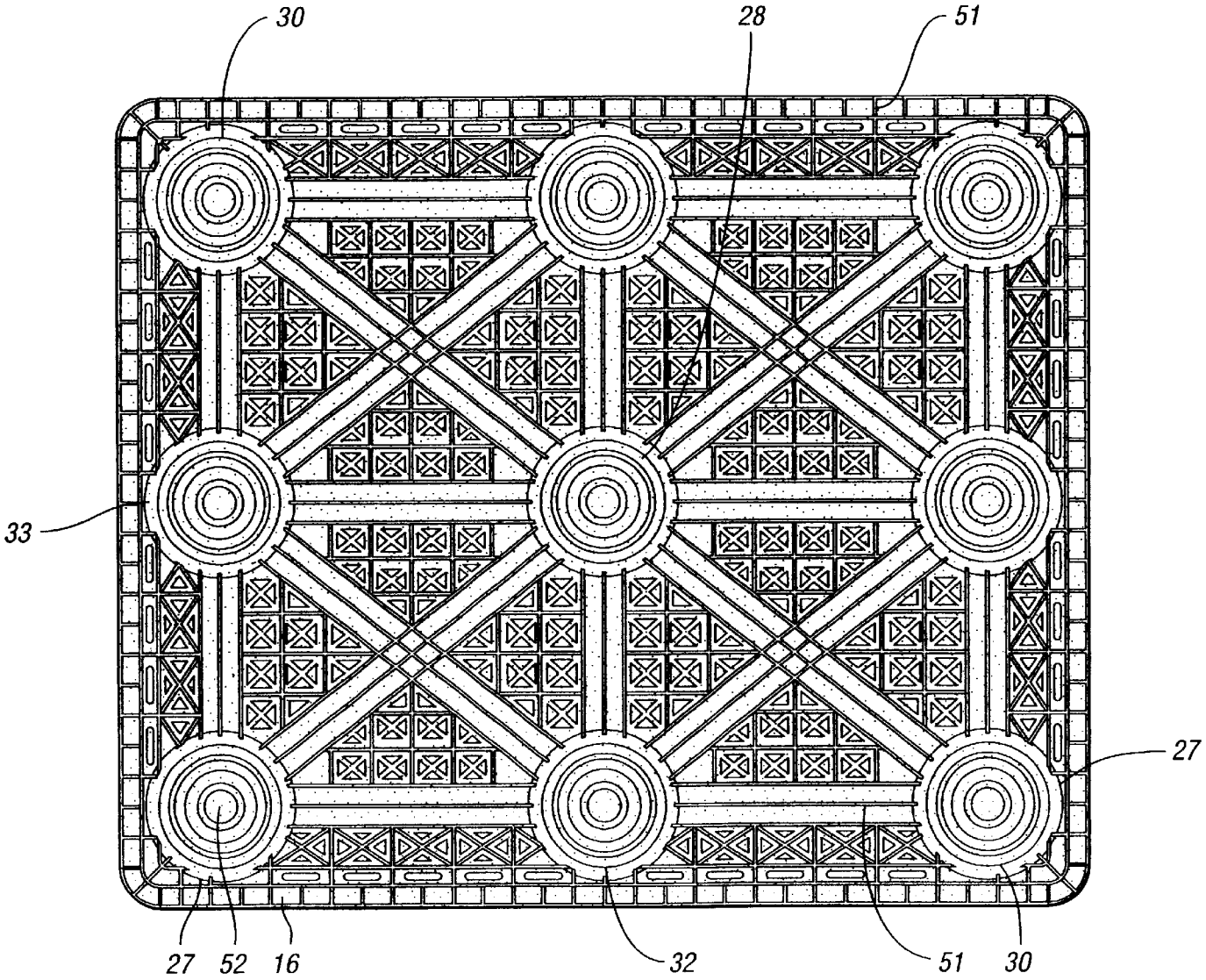
FIG. 3 is a bottom plan view of the first embodiment.

As illustrated in FIGS. 1–7, pallet 10 includes a top deck portion 12 which has an upper surface 14 and a lower surface 16. With reference to FIGS. 2 and 3, in plan view, top deck portion 12 preferably has a rectangular shape with rounded corners, but may also take other shapes, including but not limited to a square, circular, triangular or other shapes as desired or required by the use and application. Pallet 10 is preferably and generally symmetrical about each centerline. Upper surface 14 is preferably a substantially flat planar surface for allowing goods and objects to securely rest thereon. Top deck portion 12 includes a first pair of opposing edges 18 and 20, and a second pair of opposing edges 22 and 24.

Pallet 10 also includes a plurality of cup members 26 which extend from the underside of top deck portion 12 and allow like pallets to nest with each other. Cup members 26 typically have an axis 43 which is perpendicular to upper surface 14. Members 26 may also be referred to as feet, columns, or pods, etc. and have a bottom surface 25 which serve to support pallet 10 upon a resting surface, such as the ground or a floor. In a nesting orientation, shown in relation to later embodiments such as in FIGS. 11, 19, 27 etc, members 26 are also received by a like pallet 10.

Figure 43:
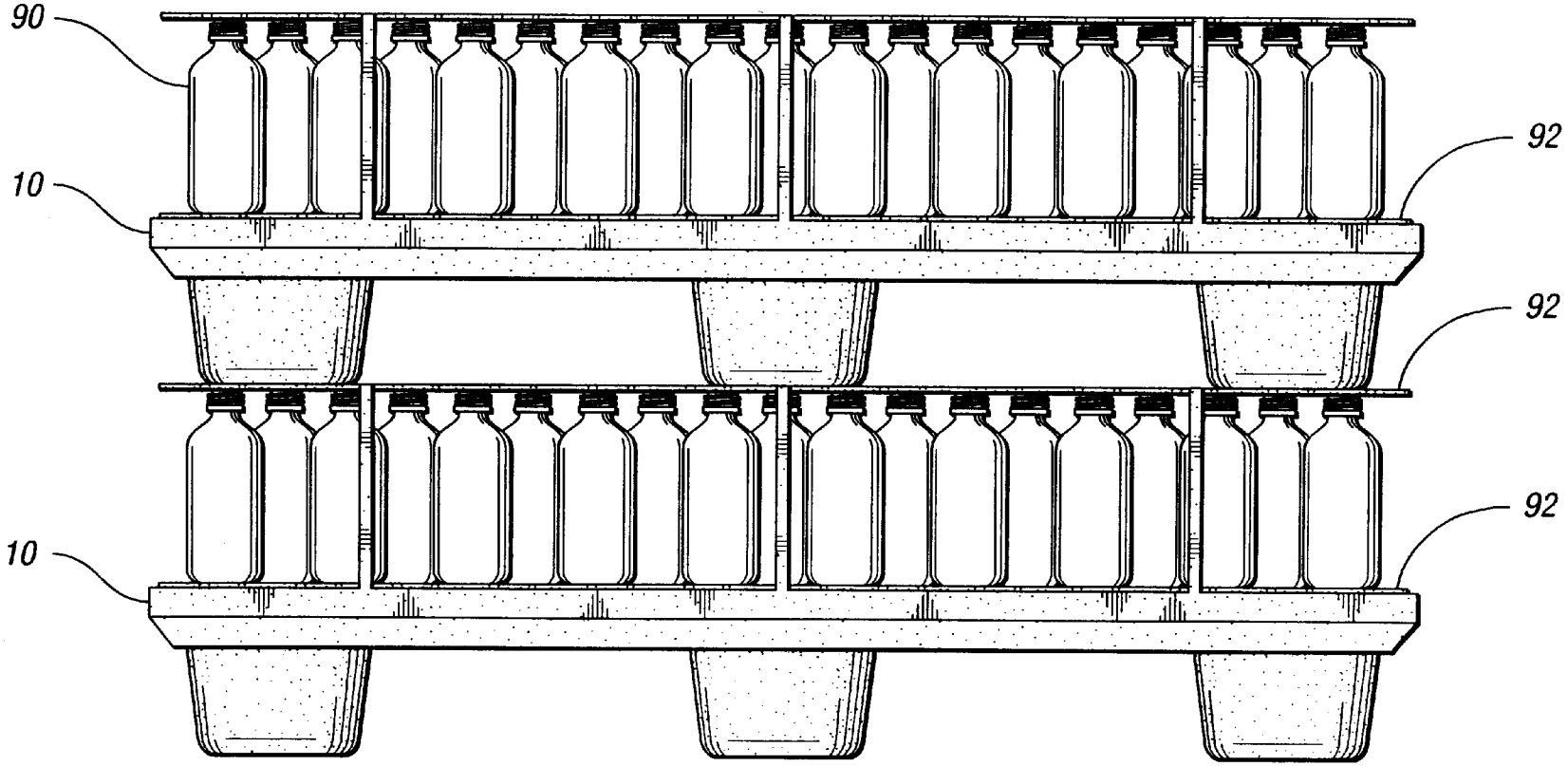
FIG. 43 is a side elevational view of a pallet according to the present invention with goods stacked thereon.

As illustrated in FIG. 43, for example, the goods or objects placed upon upper surface 14 may be a plurality of bottles 90 used in the bottled beverage industry. Such bottles are often placed upon such pallets individually in bulk, or in lightweight cardboard containers. As long as the bottles are of uniform height, it is desirable to stack several loaded pallets on top of one another so that they can be moved about collectively by fork lift, and efficiently stored in a stacked configuration either on a floor or on a shelf or rack.

Figure 4:
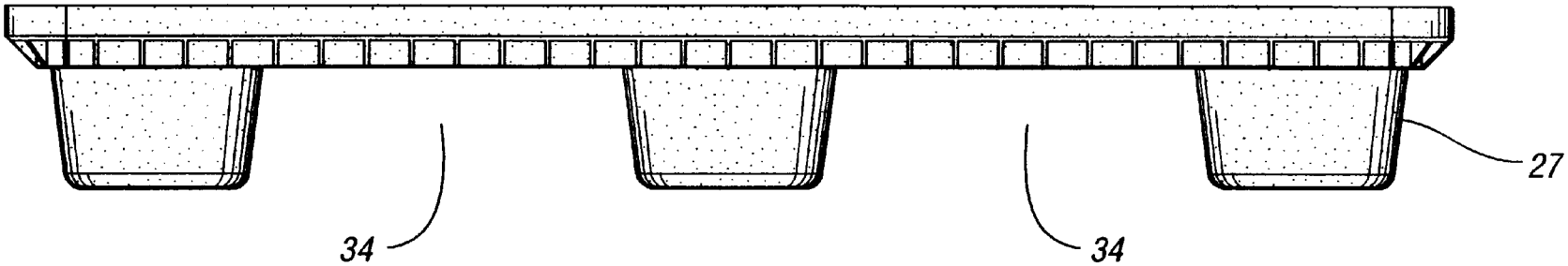
FIG. 4 is a front elevational view of the first embodiment.
Figure 5:
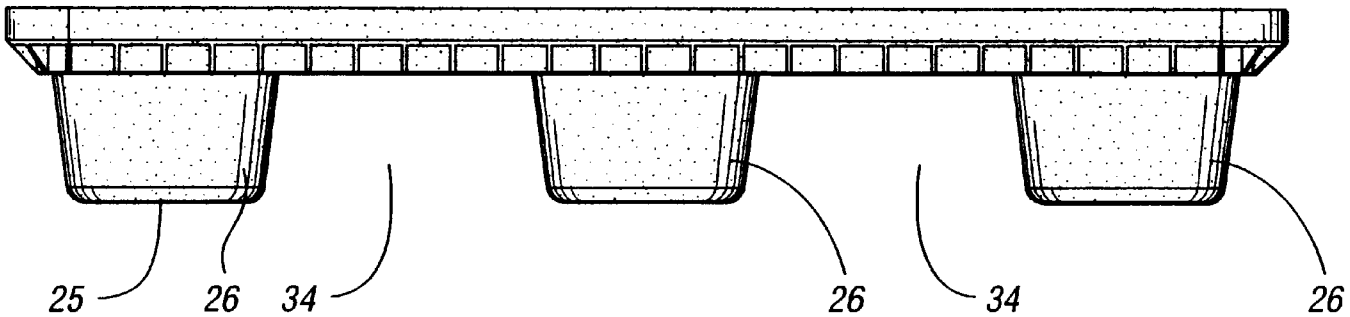
FIG. 5 is a side elevational view of the first embodiment.

In the embodiment illustrated, pallet 10 preferably includes nine cup members 26, including a central member 28, corner members 30, side central members 32, and end central members 33 (best shown in the bottom plan view of FIG. 3). Of course, pallet 10 may include any number of cup members 26 as is practical. As shown in FIGS. 1–7, and as best illustrated in FIGS. 4 and 5, members 26 (and particularly corner members 30, side central members 32, and end central members 33) are spaced apart in order to define a plurality of openings 34 therebetween. In some embodiments, openings 34 may be used for receiving the forks of a fork lift or pallet jack therein, thereby allowing pallet 10 to be lifted and transported quickly and easily via the use of a fork lift, pallet jack, or similar machinery. Members 26 are shown having smooth, rounded outer surfaces 27 in order to prevent damage from fork lift trucks and the like. However, any suitable contour may be used on members 26 depending on the application. Members 26 also serve to bear and distribute the load of the objects placed upon top deck 12, and more particularly the objects intended to be supported on upper surface 14 of top deck 12. Further, members 26 are illustrated as tapered in order to enhance the nesting properties between like pallets 10.

In one embodiment, upper surface 14 is preferably non-skid in order to prevent objects from sliding off during movement or transport of pallet 10, or when stacking other pallets thereon. Again, however, any suitable surface texture or geometry may be used on upper surface 14 depending on the application without departing from the spirit and scope of the invention.

In a preferred embodiment, top deck portion 12 also has a plurality of apertures 36 formed therethrough. Apertures 36 perform various functions, including decreasing the overall weight of pallet 10 due to a reduction in the amount of material needed for top deck portion 12. Less material also means that pallet 10 is less expensive to manufacture, assuming that all other parameters are equivalent. Apertures 36 also allow for drainage in the event pallet 10 becomes wet, so that the liquid/debris is not accumulated thereon. Thus, such apertures 36 are particularly helpful when washing the pallet. Each aperture 36 is shown in FIGS. 1–7 as being triangular in shape. However, apertures 36 may be any suitable shape, dimension, frequency, and density and disposed in a variety of combinations ranging from densely perforated to no perforations (see FIGS. 8–11) depending on the desired application. Thus, top deck portion 12 may have a continuous upper surface 14 without apertures 36, as shown in FIGS. 8–11. Also, in conjunction with a vacuum operated removal device for removing objects from a pallet, apertures 36 lessen the suction power so that the pallet is not lifted with the objects.

Figure 6:
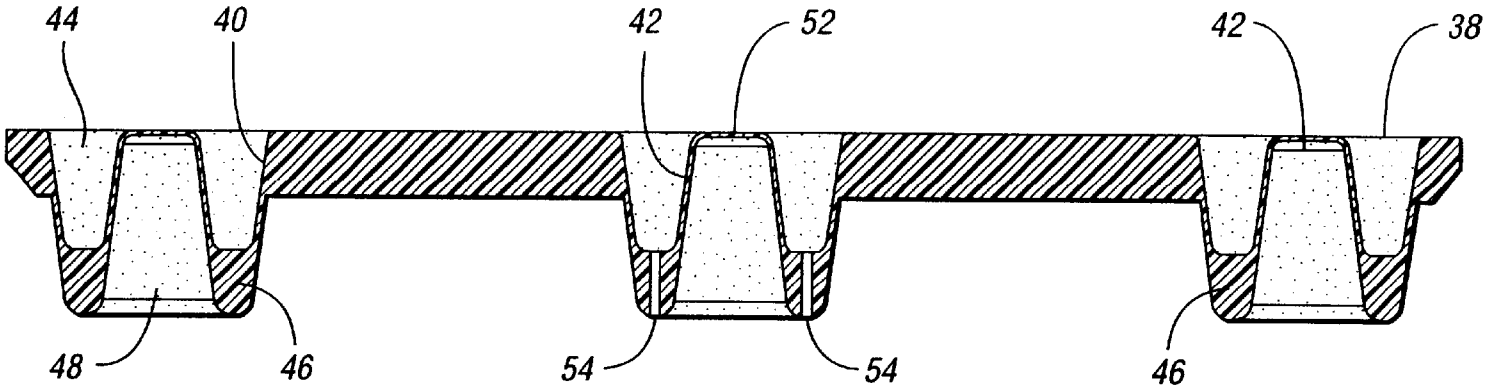
FIG. 6 is a sectional view taken along the line 6—6 of FIG. 2.
Figure 7:
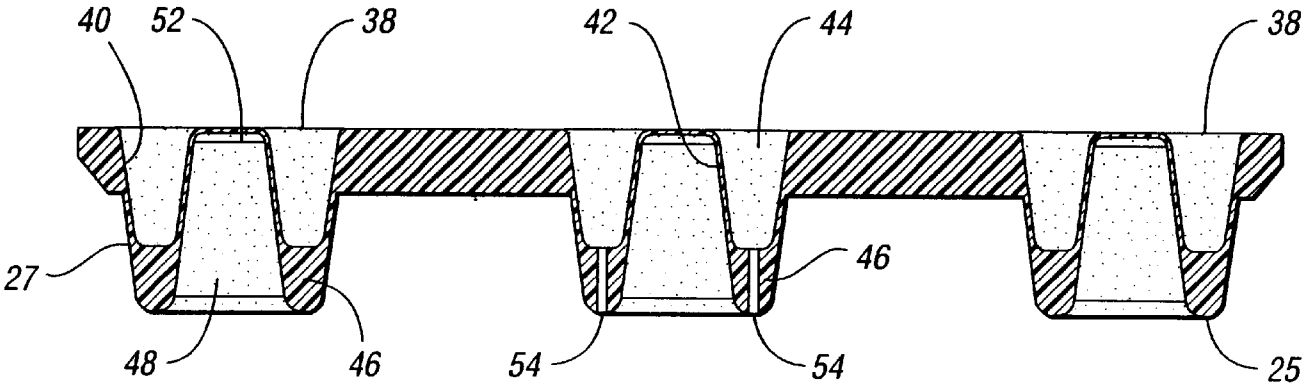
FIG. 7 is a sectional view taken along the line 7—7 of FIG. 2.

Referring to FIGS. 1 and 2 and the cross-sectional views of FIGS. 6 and 7, upper surface 14 of top deck 12 also includes a plurality of openings 38. While openings 38 in this embodiment have a circular shape, the shape may vary as shown in later disclosed embodiments. Each opening 38 corresponds to one of the members 26. As shown in the sectional views of FIGS. 6 and 7, each opening 38 defines an inner surface 40 of its corresponding member 26. FIG. 6 is a cross-sectional view of pallet 10 taken along the line 6—6 of FIG. 2. FIG. 7 is a sectional view of pallet 10 taken along the line 7—7 of FIG. 2.

In keeping with the teachings according to the present invention, each member 26 includes an upright member 42 (or cone member) which is preferably centrally disposed and is generally tapered, as shown in the sectional views of FIGS. 6 and 7. Upright member 42 has an axis (which may be equivalent to axis 43 as in the first embodiment) which is perpendicular to upper surface 14. Opening 38, inner surface 40, and upright member 42 together define a pocket 44 for receiving from above a like member 26 during a nesting orientation of pallets 10. Pocket 44 may include one or more ribs 46 or other member which serve as a nesting stop, so that pallets 10 may be nested to a predetermined depth.

Likewise, each upright member 42 is defined by a generally hollow opening 48 or area disposed thereunder, formed when outer surface 27 of a given member 26 is turned upward toward top deck 12. Thus hollow opening 48 is designed to receive from below a subjacent like upright member 42 of a similar pallet 10 in a nesting orientation. One or more ribs 50 or other members may also be disposed within hollow opening 48 for serving as a nesting stop, again so that pallets 10 may be nested to a predetermined depth. In addition, lower surface 16 of top deck 12 preferably has a plurality or pattern of ribs 51 formed thereunder (see FIG. 3). These ribs 51, as well as ribs 46 and 50, may also be utilized to provide stiffness and improved structural integrity to pallet 10.

By projecting into pocket 44, upright member 42 serves as an "island" or barrier within pocket 44, so that goods placed upon pallet 10 are not able to fall into or become lodged within pocket 44. Thus, depending on the application and the size of the goods to be supported on pallet 10, upright member 42 may be appropriately sized so that no portion of such goods are received within pocket 44. Similar, a slip sheet 92 may be disposed upon upper surface 14 of top deck 12 of pallet 10 prior to the placement of goods thereon, as shown in FIG. 43. During such use, upright member 42 provides additional support and load-bearing and load-distribution properties to pocket area 44. For example, a slip sheet in the area of pocket 44 and having an upright member 42 is stronger and better able to bear loads than a slip sheet over a pocket with no upright member. This is particularly helpful when loaded pallets 10 are stacked upon similar loaded pallets 10. Thus, a slip sheet in the area of apertures 36 (pocket 44) is better capable of supporting the weight and load of not only the goods resting directly thereon, but also the weight and load of similar pallets 10 stacked thereupon.

FIG. 3 of the drawings illustrates a bottom plan view of pallet 10. As shown therein, lower surface 16 of top deck 12 is substantially flat and planar for stable orientation on a similarly designed pallet 10 for nesting and stacking purposes. FIGS. 1, 2, 3, 6 and 7 illustrate that each upright member 42 is tapered and has an upper surface 52. Moreover, with reference to FIGS. 6 and 7, at least one aperture 54 may be disposed at the lower surface of each pocket 44 to allow for the drainage of liquid, so that liquid does not accumulate in pocket 44 when washing pallet 10 or when pallet 10 is left exposed to the environment.

With reference to FIG. 43, during a stacking orientation, a first slip sheet may be placed upon pallet upper surface 14. Then a layer of objects 90 (shown as bottles) is loaded on pallet 10. Typically, a planar member 92 is positioned on the upper surface of bottles 90. Planar member 92 may be referred to as a slip sheet in the art, and is typically formed of cardboard or fiberboard. As illustrated, another pallet may be disposed on top of planar member 92, and then another planar member 92 may be positioned on top of that layer of bottles 90.

Figure 10:
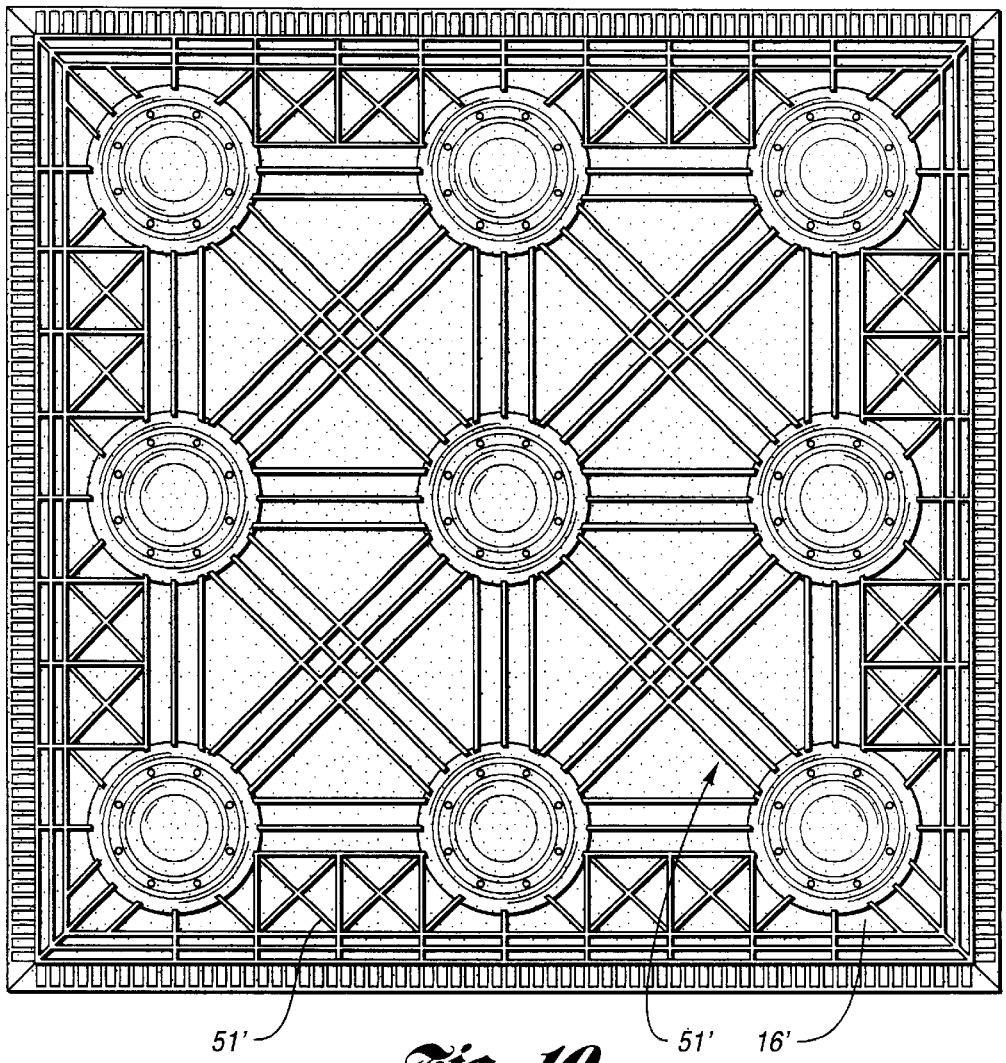
FIG. 10 is a bottom plan view of the alternate first embodiment of FIG. 8.
Figure 11:
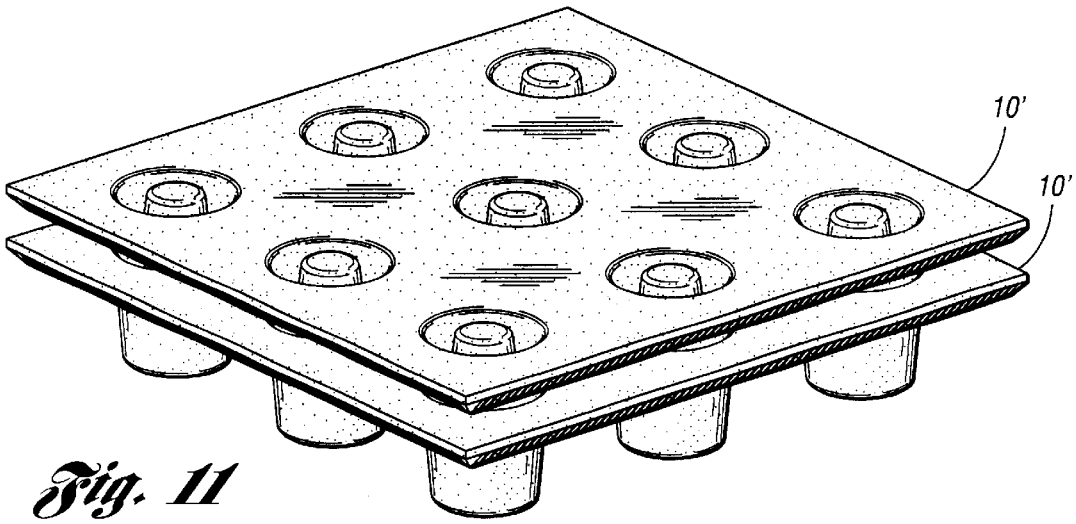
FIG. 11 is a top perspective view illustrating a pallet of the alternate first embodiment nested within a like pallet.

FIGS. 8–11 illustrate an alternate design to the first embodiment of pallet 10 illustrated and described in association with FIGS. 1–7, and in accordance with the present invention. Particularly, the alternate first embodiment pallet 10' is similar to pallet 10 but without apertures 36 in upper surface 14' of top deck 12'. With reference to FIGS. 8–11, note that similar features to those disclosed in the first embodiment of FIGS. 1–7 are assigned a like reference numeral with a prime (') designation. FIG. 8 is a top perspective view of pallet 10' of the alternate first embodiment. FIG. 9 is a top plan view of pallet 10' illustrating that upper surface 14' is continuous (does not include openings 38'). FIG. 10 is a bottom plan view of pallet 10'. FIG. 10 illustrates the plurality of ribs or rib pattern 51' on lower surface 16' of top deck 12'. FIG. 11 is a top perspective view illustrating pallet 10' of the alternate first embodiment nested within a like pallet 10'.

Figure 12:
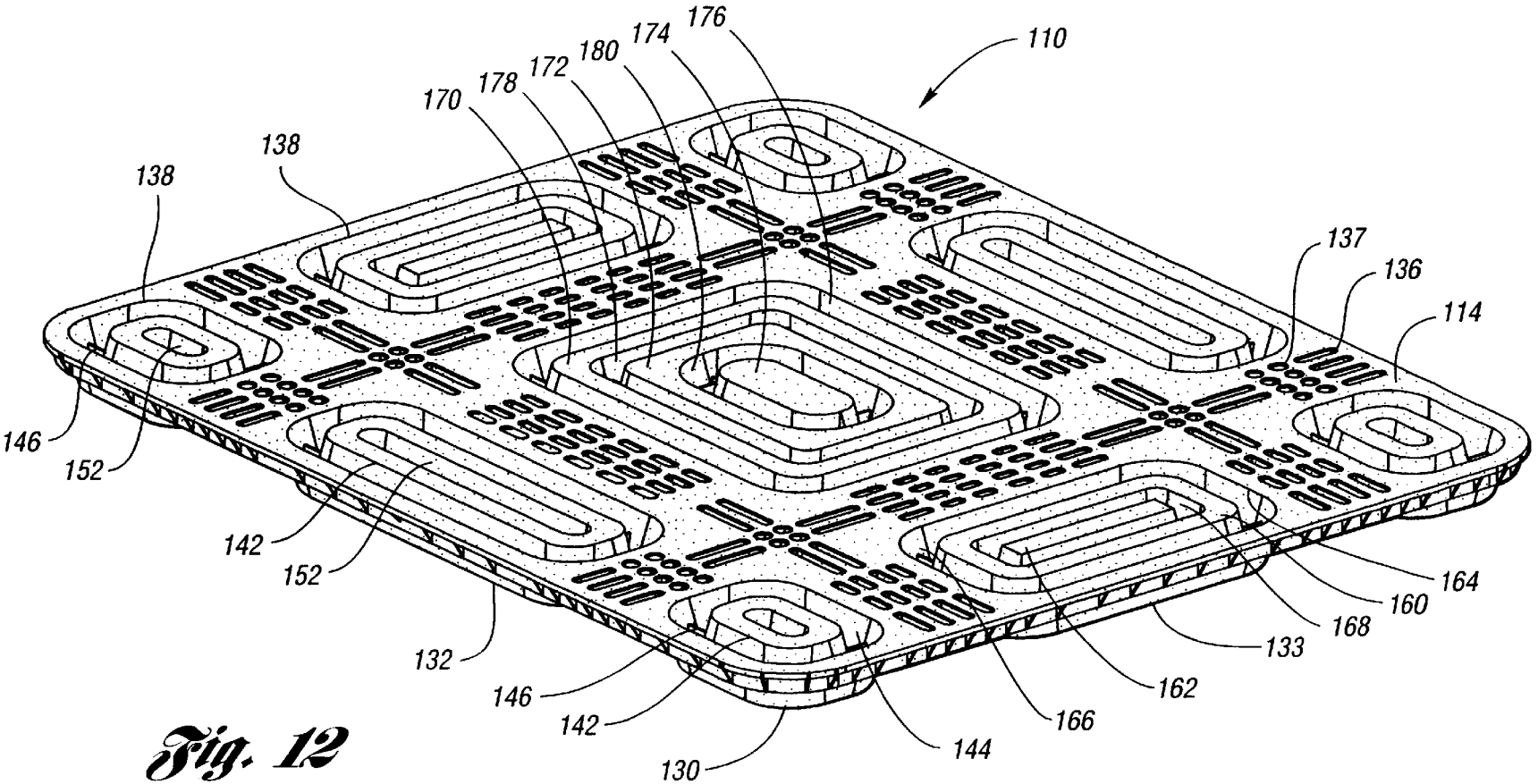
FIG. 12 is a top perspective view of a second embodiment of a nestable pallet according to the present invention.
Figure 13:
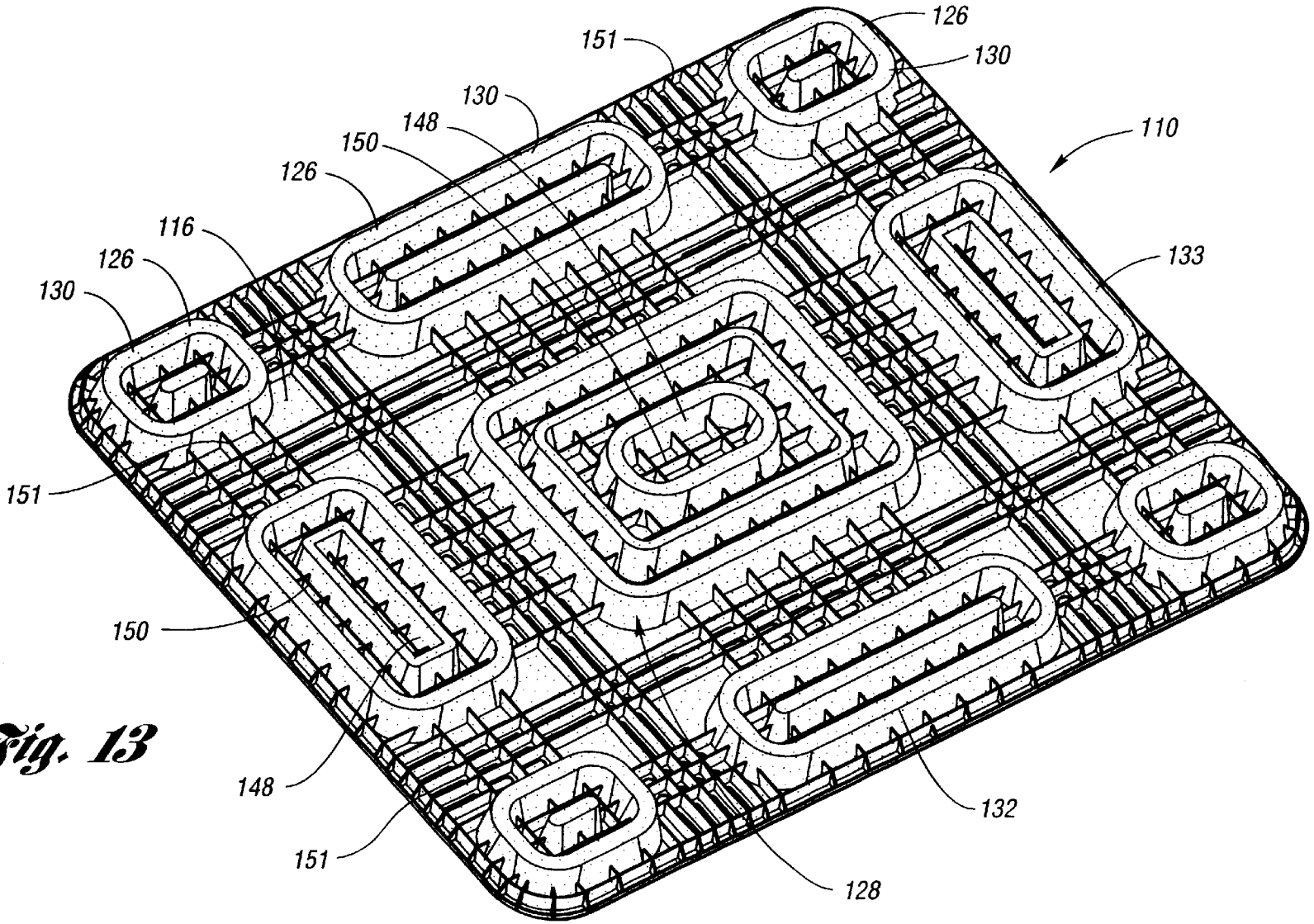
FIG. 13 is a bottom perspective view of the second embodiment.

With reference now to FIGS. 12–19 of the drawings, shown therein is a second embodiment of a nestable pallet 110 according to the present invention. With reference to FIGS. 12–19, note that similar features to those disclosed in the first embodiment of FIGS. 1–7 are assigned a like reference numeral with the addition of a "1" in front of the reference numeral. FIG. 12 is a top perspective view of nestable pallet 110. Note that apertures 136 in top deck 112 are illustrated as generally elliptical 136 or round 137, but as previously disclosed, may be any shape practical. Further, as shown in FIG. 13, each member 126 is generally rectangular in shape with rounded corners. As illustrated in FIG. 12, note also that each corner member 130 and each side central member 132 has one upright member 142 disposed therein. On the other hand, each end central member 133 has a first upright member 160 and a second upright member 162. Thus, inner surface 164 of end central member 133 defines a first pocket 166 with first upright member 160, while first upright member 160 and second upright member 162 define therebetween a second pocket 168. Moreover, center member 128 has a first upright member 170, a second upright member 172, and a third upright member 174, defining respectively first, second, and third pockets 176, 178, and 180, therebetween.

Figure 14:
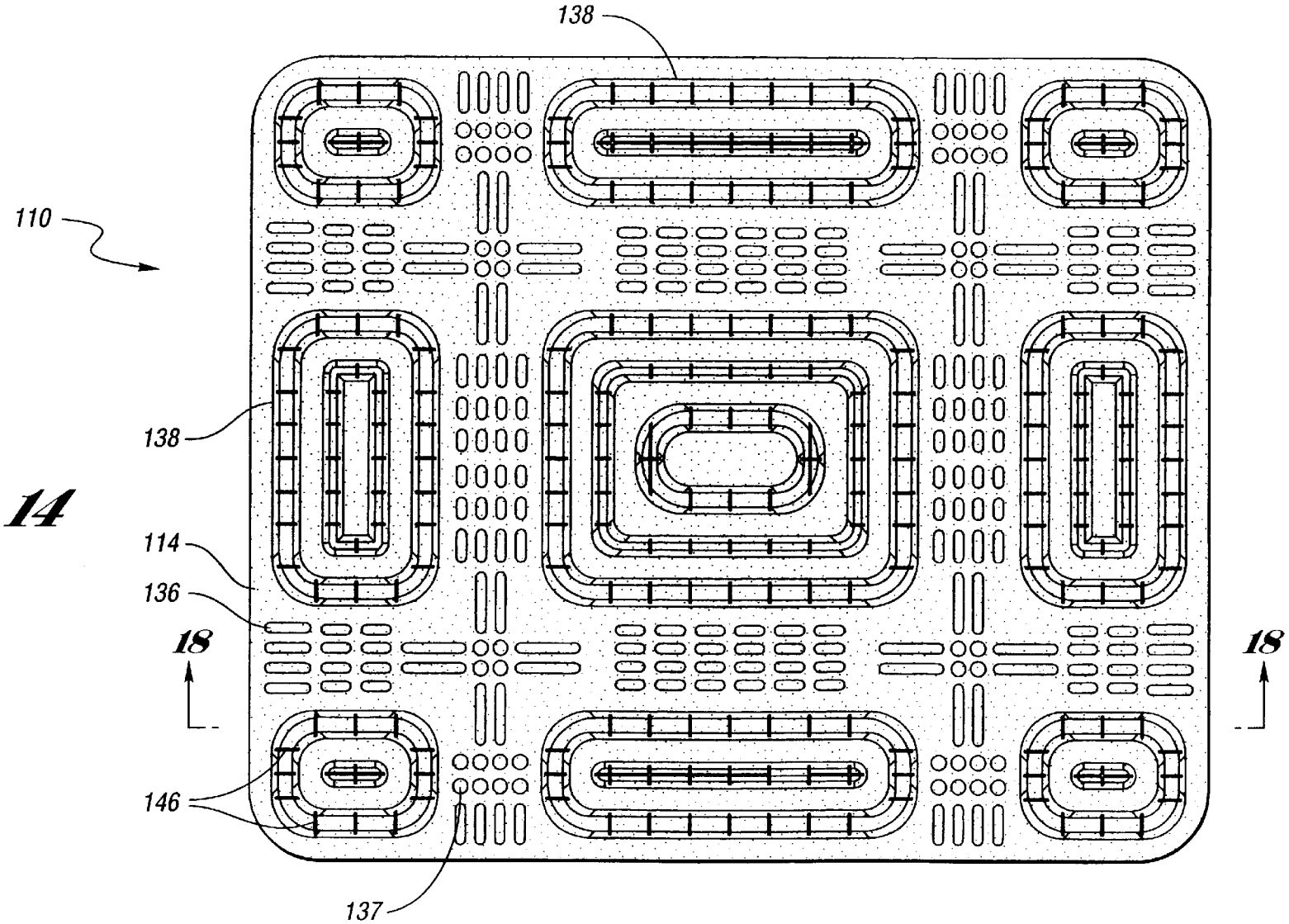
FIG. 14 is a top plan view of the second embodiment.
Figure 15:
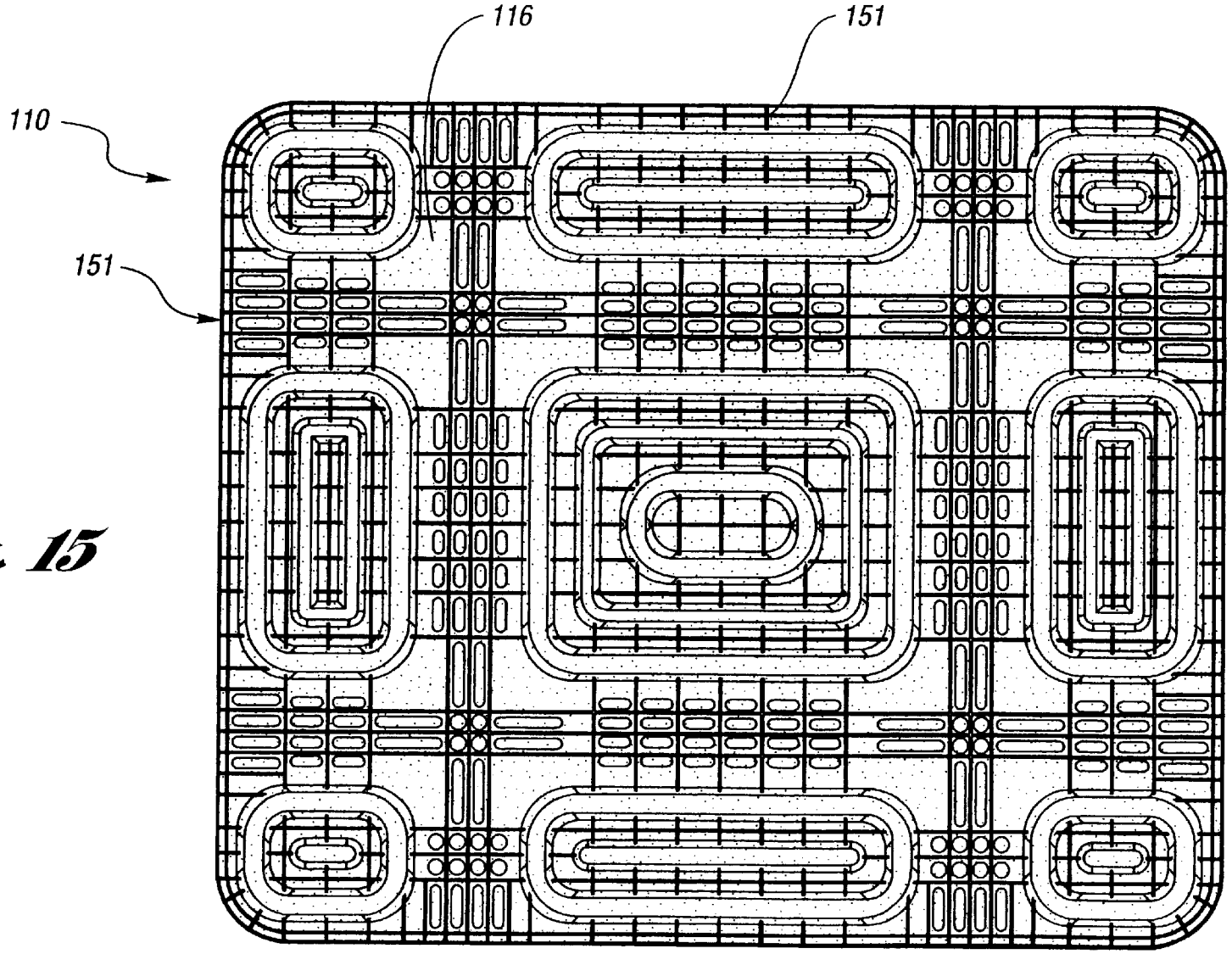
FIG. 15 is a bottom plan view of the second embodiment.
Figure 16:
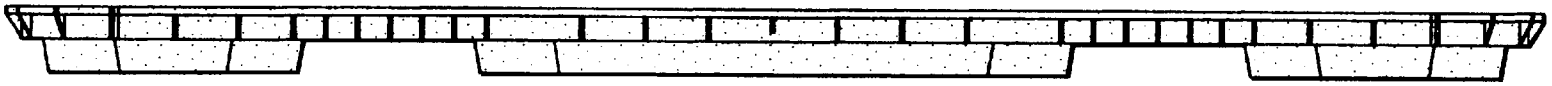
FIG. 16 is a front elevational view of the second embodiment.
Figure 17:
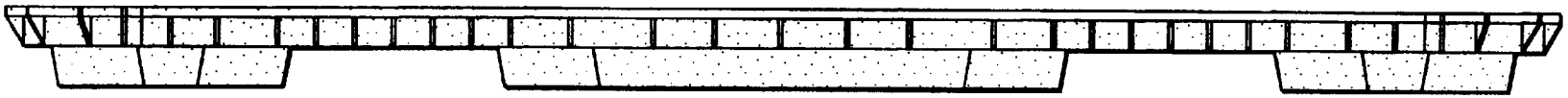
FIG. 17 is a side elevational view of the second embodiment.
Figure 18:
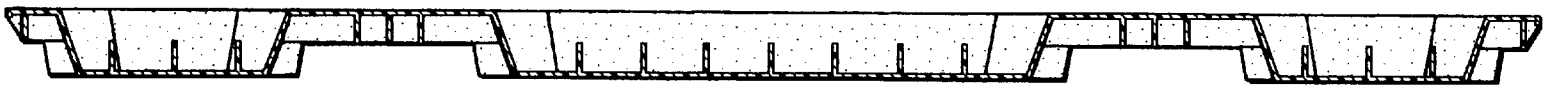
FIG. 18 is a sectional view taken along the line 18—18 of FIG. 14.

Relative to the first embodiment shown in FIGS. 1–7, the use of multiple upright members in the various cup members 126 thereby decreases the relevant pocket size, thereby decreasing the possibility that goods (or any portion of goods, such as bottles 90) placed upon upper surface 114 may become lodged within an adjacent pocket. Likewise, in the event that a slip sheet 92 (see FIG. 43) is disposed over openings 138, multiple upright members as shown in this second embodiment of pallet 110 serve to increase the load bearing and load distribution properties, allowing the load to be spread out among the multiple upright members. FIG. 13 is a bottom perspective view of pallet 110 showing the pattern of ribs 151 as well as the ribs 150 disposed in hollow area 148. FIG. 14 is a top plan view of pallet 110. FIG. 15 is a bottom plan view of pallet 110. FIG. 16 is a front elevational view of pallet 110. FIG. 17 is a side elevational view of pallet 110. FIG. 18 is a sectional view taken along the line 18—18 of FIG. 14.

Figure 19A:
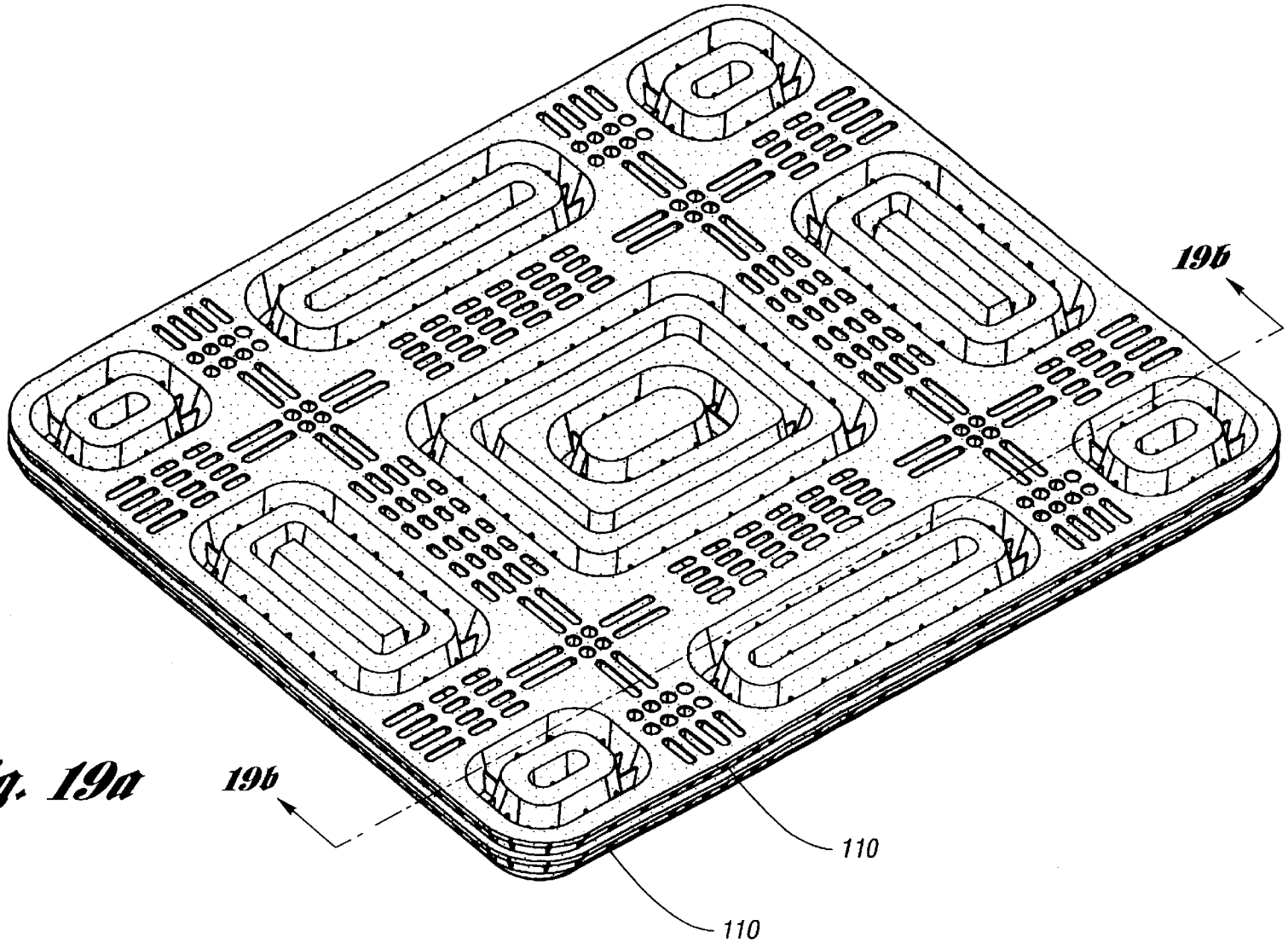
FIG. 19*a* is a perspective view showing two pallets of the second embodiment in a nested orientation.
Figure 19B:
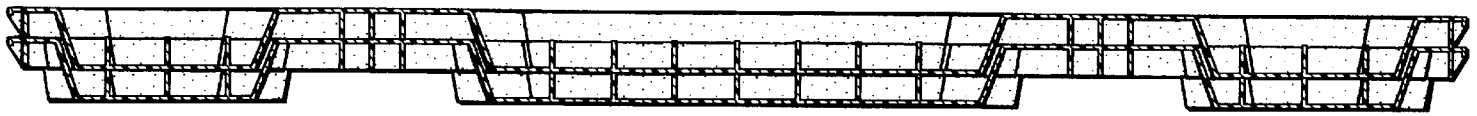
FIG. 19*b* is a cross-sectional view of nested pallets taken along line 19*b*—19*b* of FIG. 19*a*, which corresponds to line 18—18 of FIG. 14.

With reference to FIG. 19*a*, shown therein is a perspective view showing two pallets 110 of the second embodiment in a nested orientation. FIG. 19*b* is a cross-sectional view taken along line 19*b*–19*b* of FIG. 19*a*, which corresponds to the position of line 18 of FIG. 14.

Figure 20:
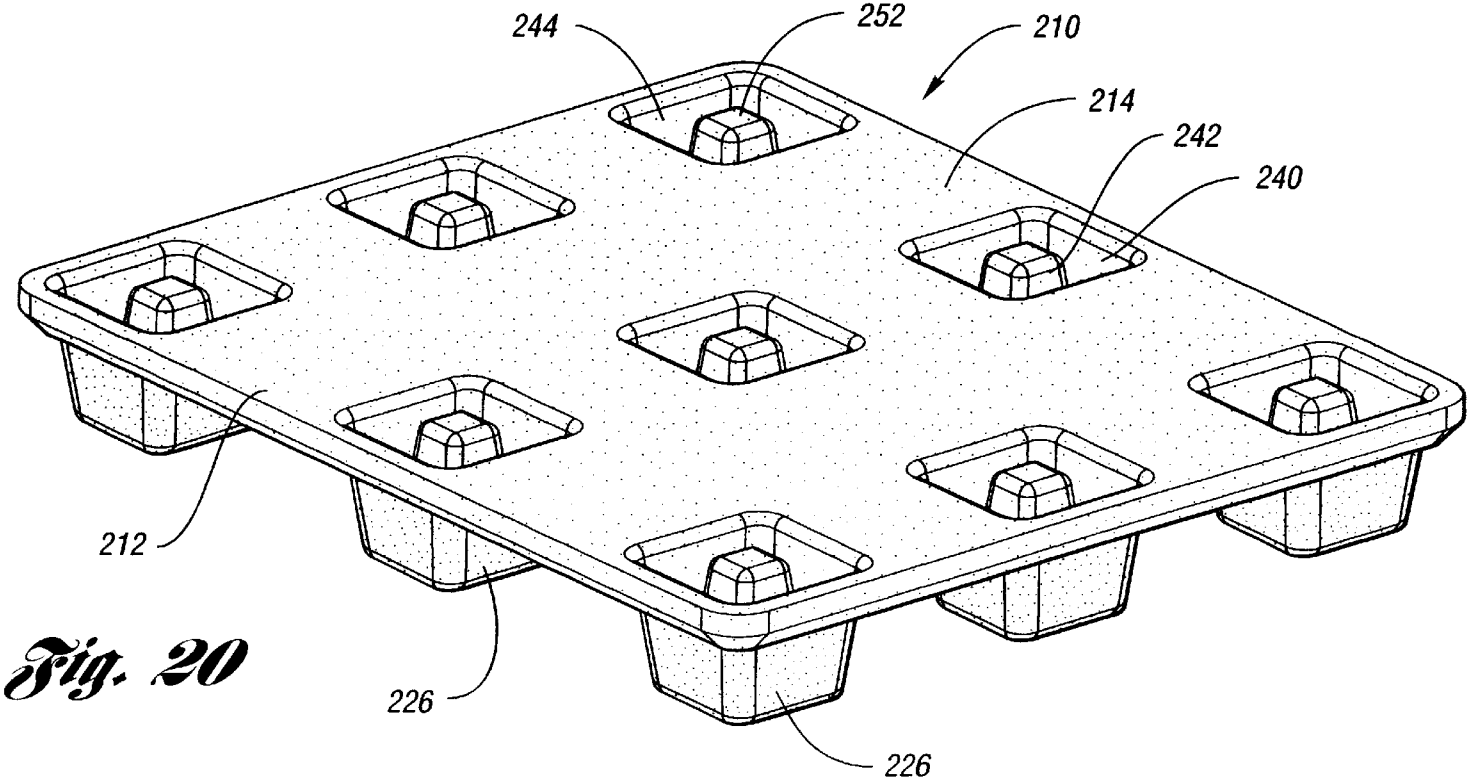
FIG. 20 is a top perspective view of a third embodiment of a nestable pallet according to the present invention.
Figure 21:
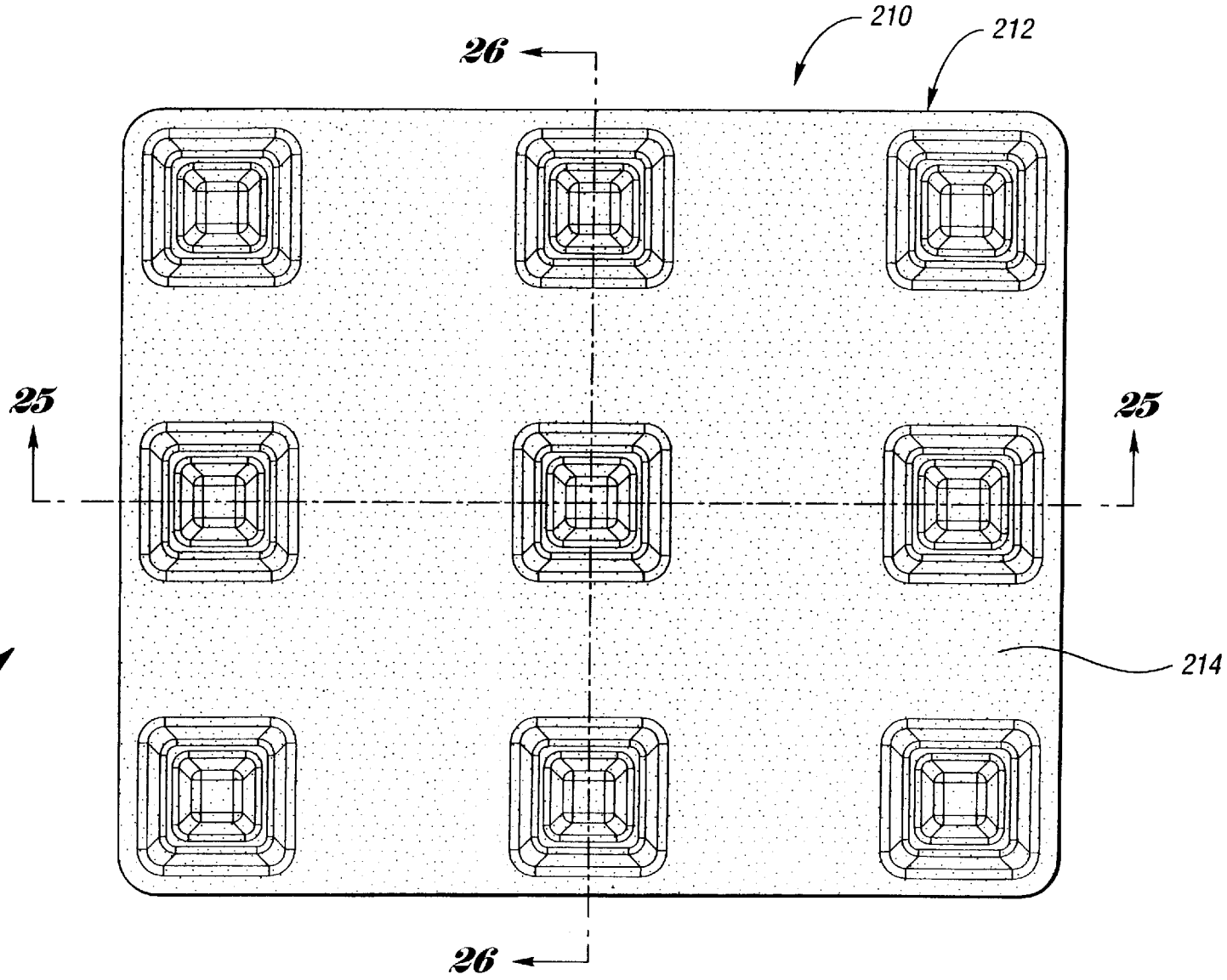
FIG. 21 is a top plan view of the third embodiment.
Figure 22:
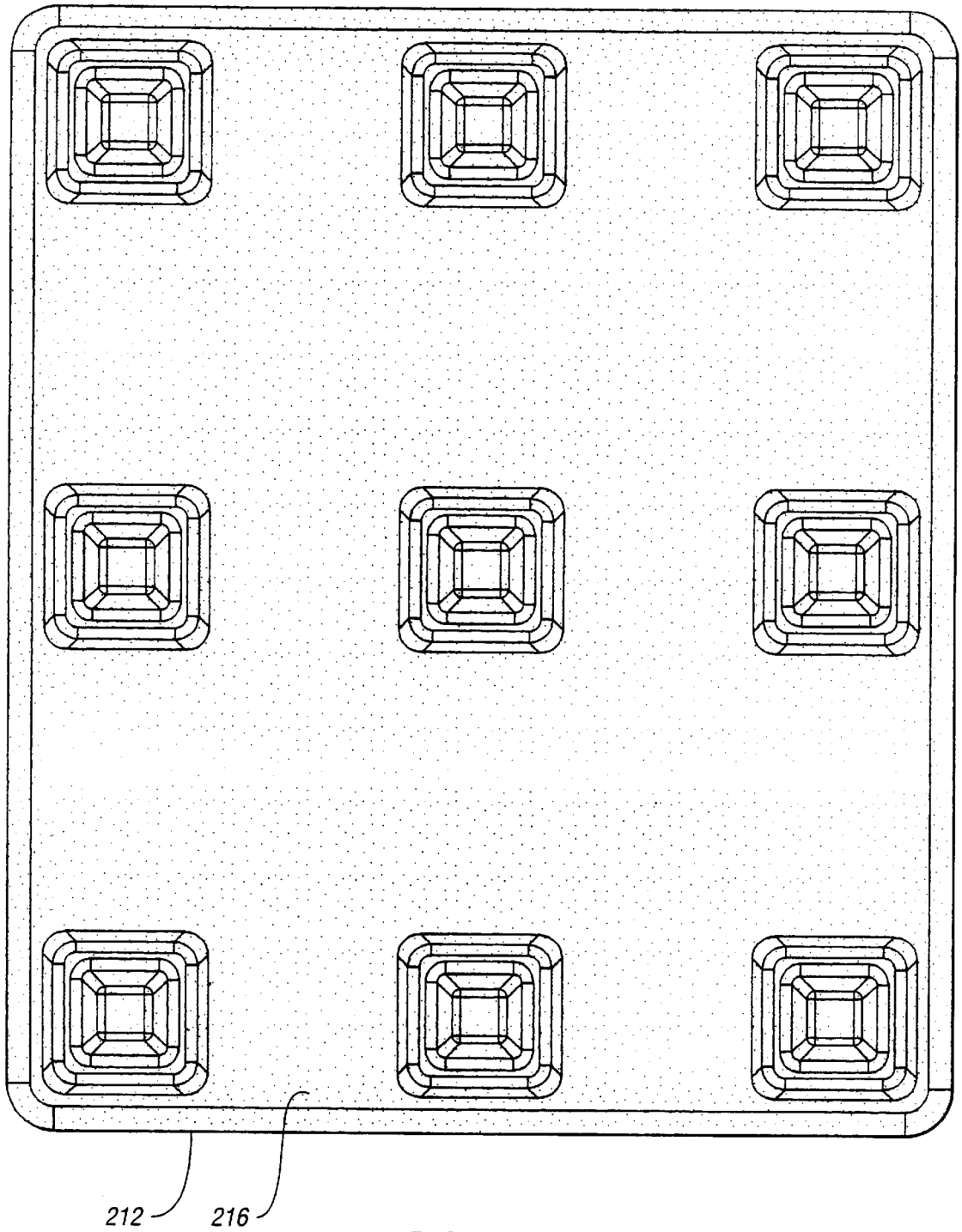
FIG. 22 is a bottom plan view of the third embodiment.
Figure 23:
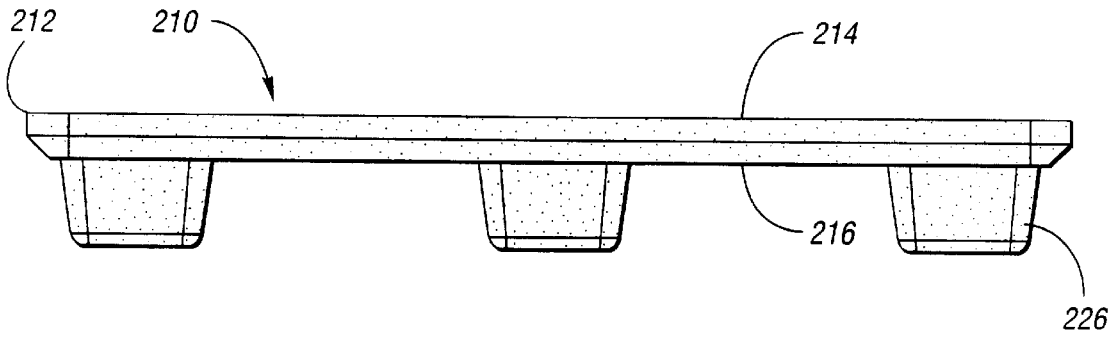
FIG. 23 is a front elevational view of the third embodiment.
Figure 24:
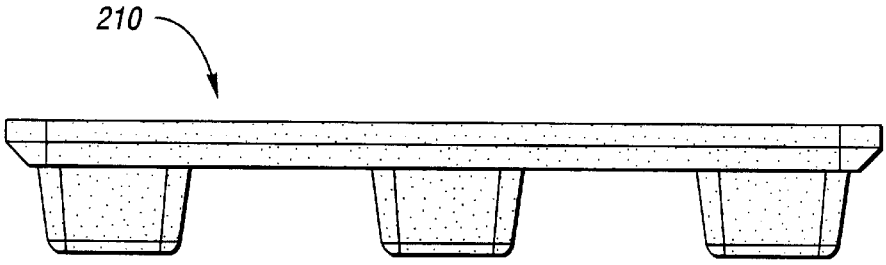
FIG. 24 is a side elevational view of the third embodiment.
Figure 25:
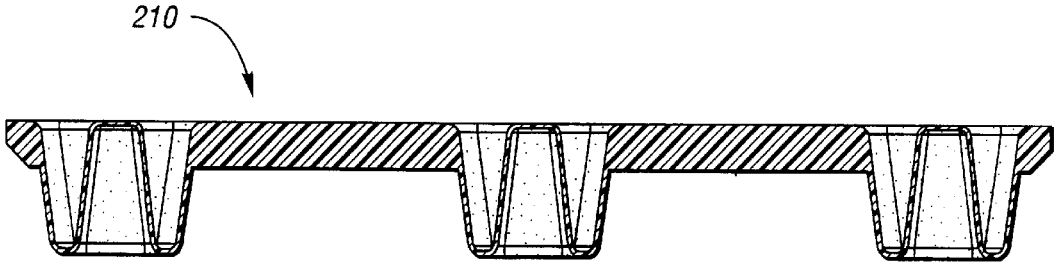
FIG. 25 is a sectional view taken along the line 25—25 of FIG. 21.
Figure 26:
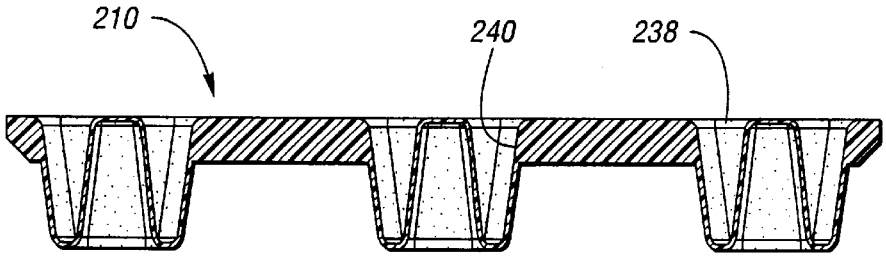
FIG. 26 is a sectional view taken along the line 26—26 of FIG. 21.

FIGS. 20–27 illustrate a third embodiment of the pallet according to the present invention, designated as pallet 210. With reference to FIGS. 20–26, note that similar features to those disclosed in the first embodiment of FIGS. 1–7 are assigned a like reference numeral with the addition of a "2" in front of the reference numeral. Thus, FIG. 20 is a top perspective view of nestable pallet 210 according to the present invention. FIG. 21 is a top plan view of pallet 210, showing top deck 212. Top deck 212 has an upper surface 214 and a lower surface 216. In this embodiment, pallet 210 includes a plurality of members 226 which have a square shape, with rounded corners. FIG. 22 is a bottom plan view of pallet 210. FIG. 23 is a front elevational view of pallet 210. FIG. 24 is a side elevational view of pallet 210. FIG. 25 is a sectional view of pallet 210 taken along the line 25—25 of FIG. 21. FIG. 26 is a sectional view of pallet 210 taken along the line 26—26 of FIG. 21.

Figure 27A:
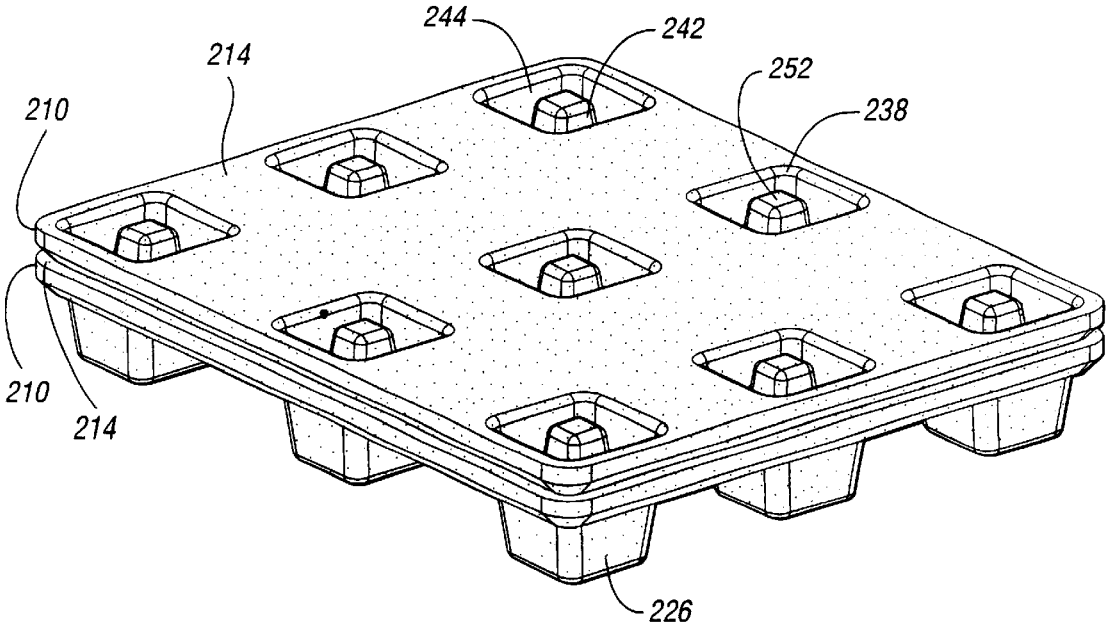
FIG. 27*a* is a perspective view showing two pallets of the second embodiment in a nested orientation.
Figure 27B:
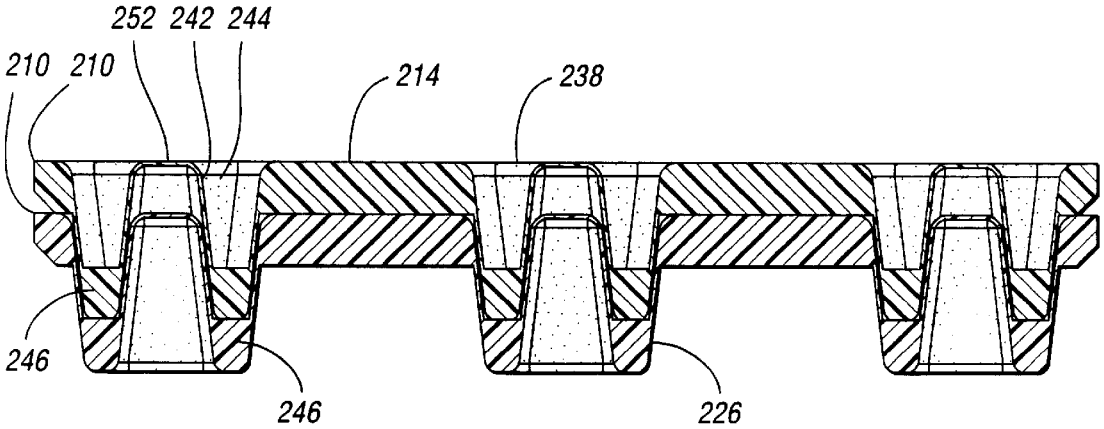
FIG. 27*b* is a cross-sectional view taken along the centerline of the nested pallets of FIG. 27*a;*

With reference to FIG. 27*a*, shown therein is a perspective view showing two pallets 210 of the second embodiment in a nested orientation. FIG. 27*b* is a cross-sectional view taken along line centerline of the nested pallets 210 of FIG. 27*a*.

Figure 28:
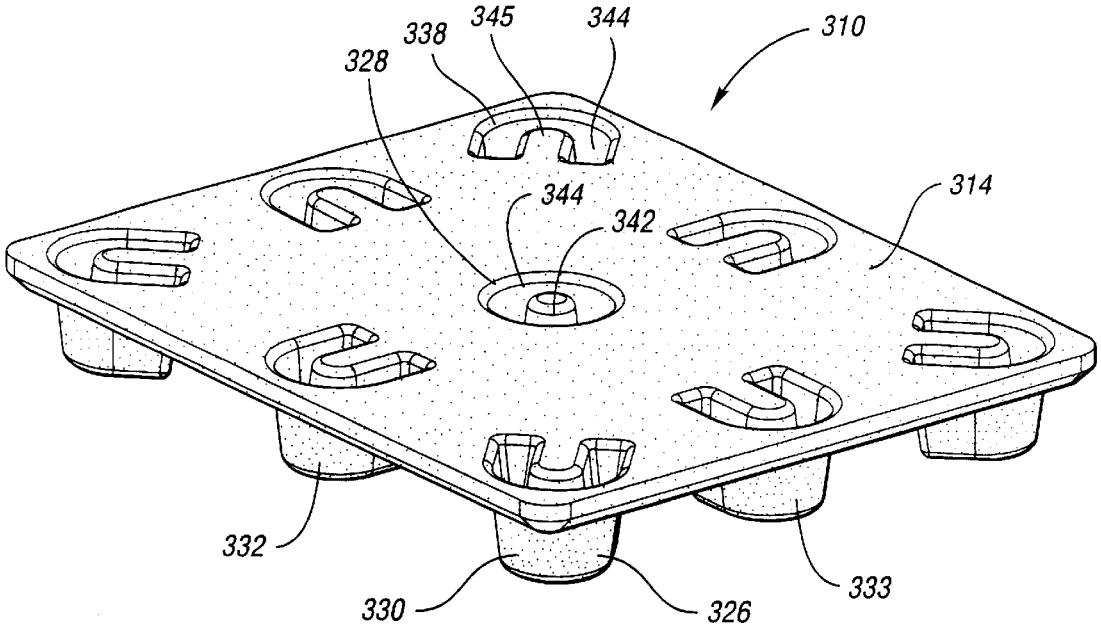
FIG. 28 is a top perspective view of a fourth embodiment of a nestable pallet according to the present invention.
Figure 29:
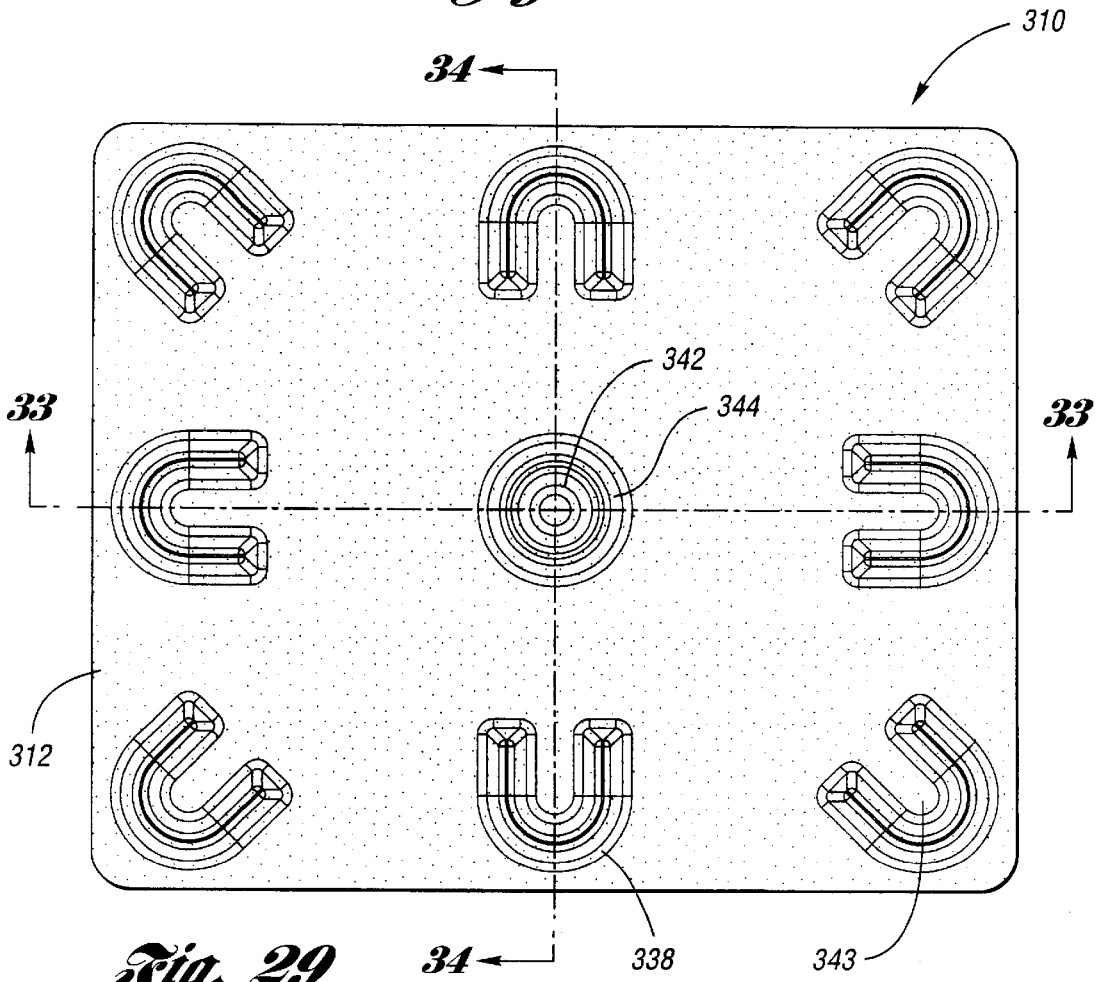
FIG. 29 is a top plan view of the fourth embodiment.

FIGS. 28–34 illustrate a fourth embodiment of the pallet according to the present invention, designated as pallet 310. With reference to FIGS. 28–34, note that similar features to those disclosed in the first embodiment of FIGS. 1–7 are assigned a like reference numeral with the addition of a "3" in front of the reference numeral. Thus, FIG. 28 is a top perspective view of nestable pallet 310 according to the present invention. FIG. 29 is a top plan view of pallet 310. In this embodiment, pallet 310 includes a plurality of corner, side central, and end central members 330, 332 and 333, respectively, which have a "U" or horseshoe shape.

Figure 30:
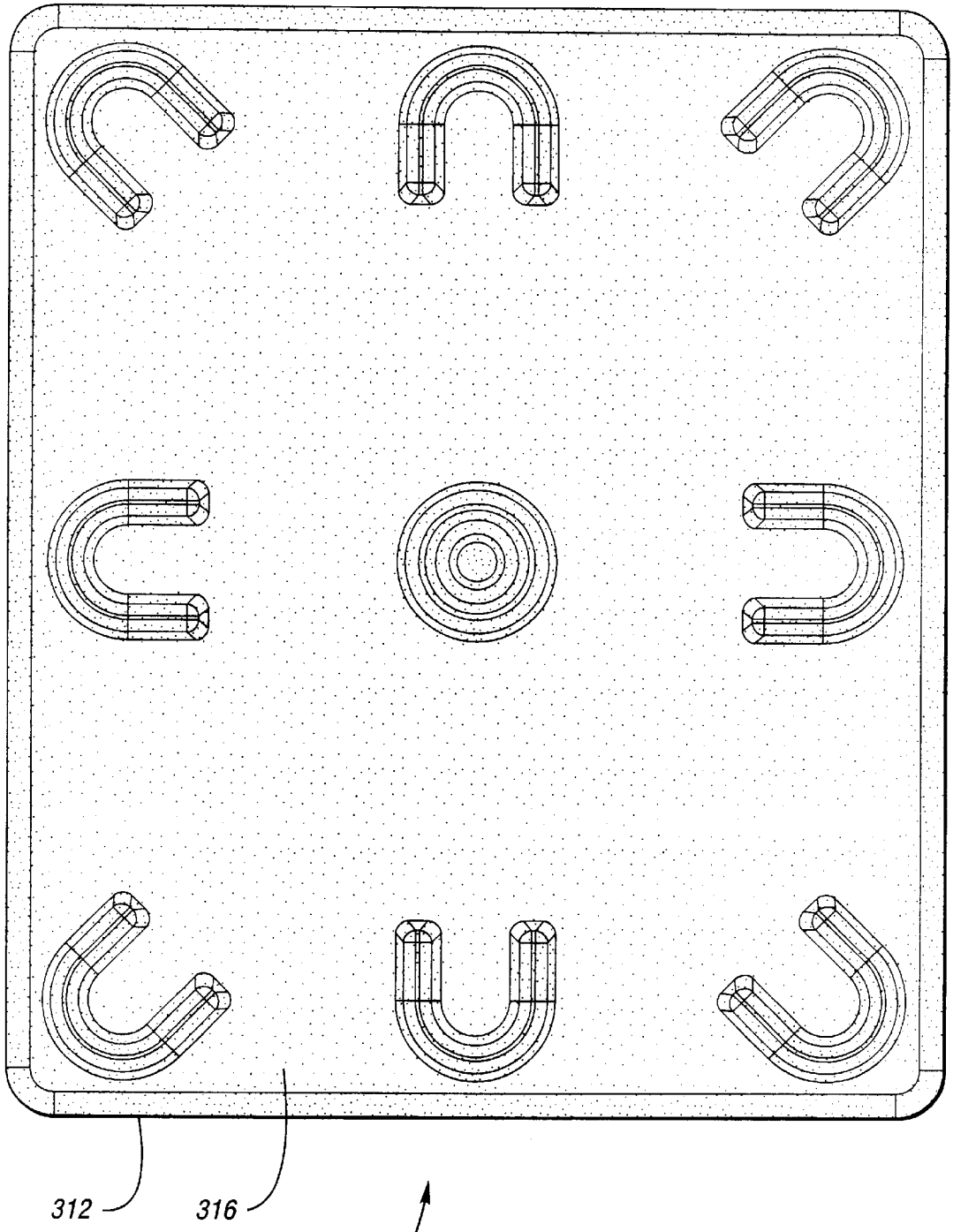
FIG. 30 is a bottom plan view of the fourth embodiment.
Figure 31:
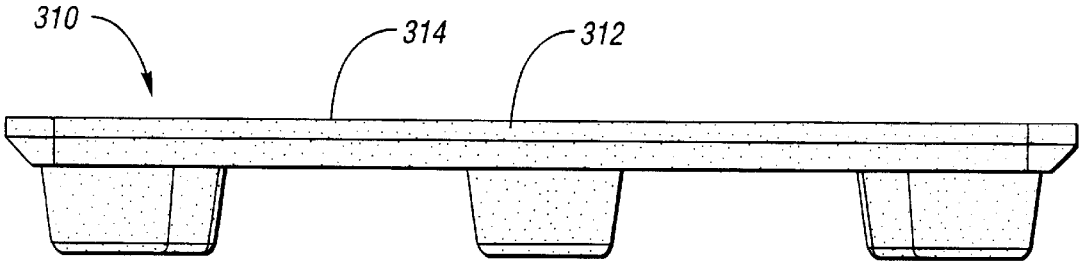
FIG. 31 is a front elevational view of the fourth embodiment.
Figure 32:
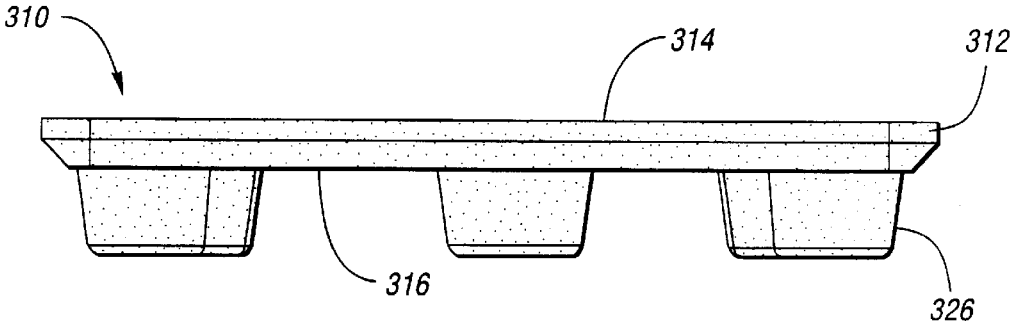
FIG. 32 is a side elevational view of the fourth embodiment.
Figure 33:
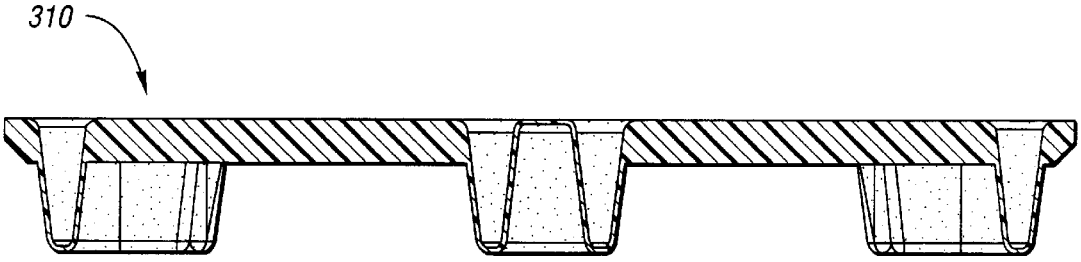
FIG. 33 is a sectional view taken along the line 33—33 of FIG. 29.
Figure 34:
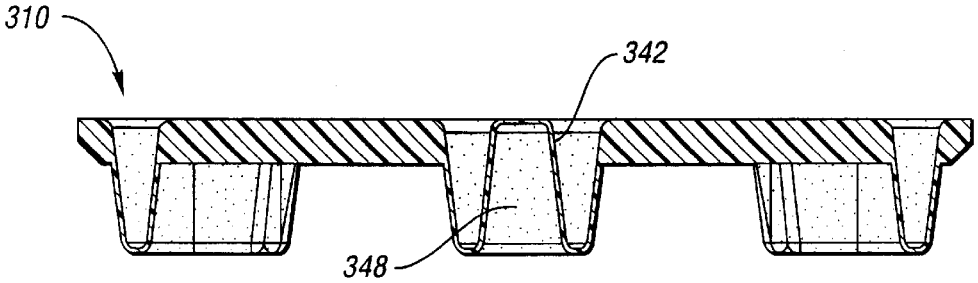
FIG. 34 is a sectional view taken along the line 34—34 of FIG. 29.

Central member 328 has a circular shape with a circular upright member 342 disposed therein. On the other hand, with reference to FIGS. 28–30 and 33–34, members 330, 332, and 333 have differently shaped upright members 345 positioned therein. It is possible for a pallet (such as pallet 310) to have various member 326 shapes, in addition to various numbers of upright members disposed in cup members 326. FIG. 30 is a bottom plan view of pallet 310. FIG. 31 is a front elevational view of pallet 310. FIG. 32 is a side elevational view of pallet 310. FIG. 33 is a sectional view of pallet 310 taken along the line 33—33 of FIG. 29. FIG. 34 is a sectional view of pallet 310 taken along the line 34—34 of FIG. 29.

Figure 35:
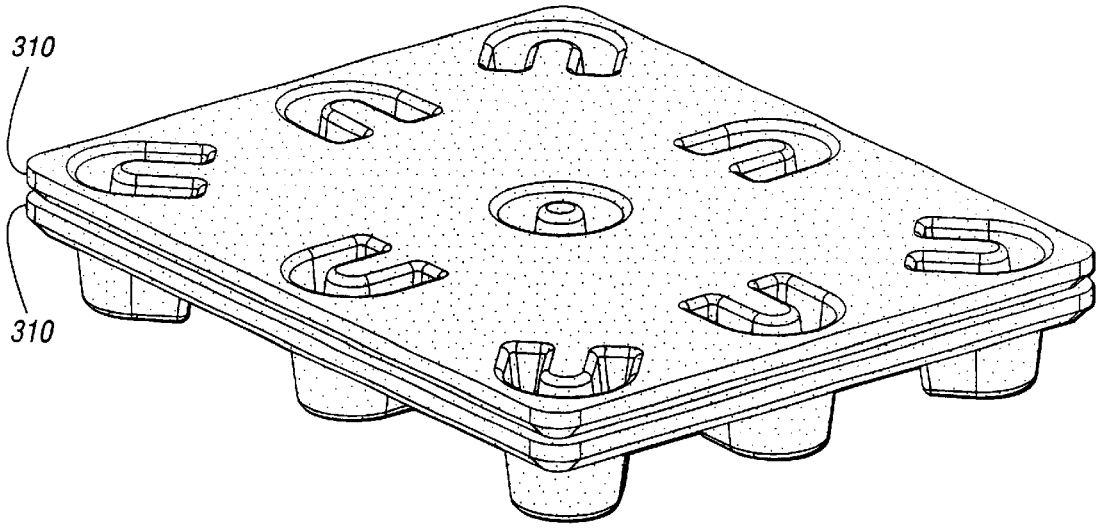
FIG. 35 is a perspective view showing two pallets of the fourth embodiment in a nested orientation.

FIG. 35 is a perspective view showing two pallets 310 of the fourth embodiment in a nested orientation.

Figure 36:
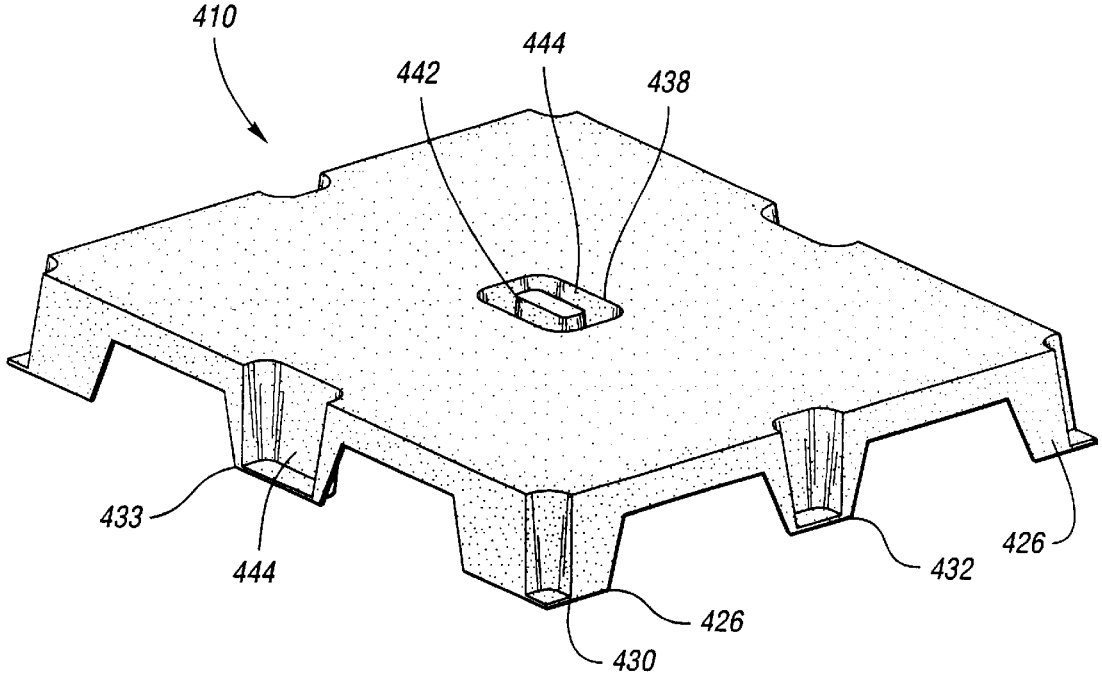
FIG. 36 is a top perspective view of a fifth embodiment of a nestable pallet according to the present invention.
Figure 37:
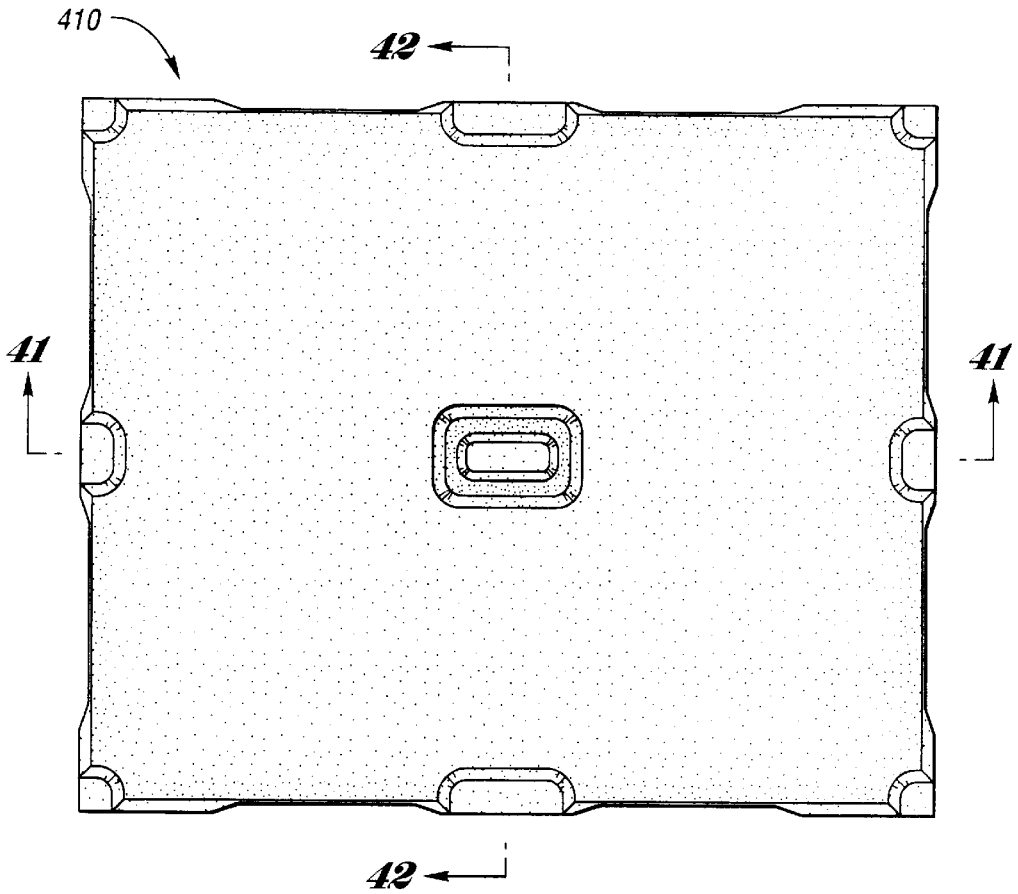
FIG. 37 is a top plan view of the fifth embodiment.

FIGS. 36–42 illustrate a fifth embodiment of the pallet according to the present invention, designated as pallet 410. With reference to FIGS. 36–42, note that similar features to those disclosed in the first embodiment of FIGS. 1–7 are assigned a like reference numeral with the addition of a "4" in front of the reference numeral. Thus, FIG. 36 is a top perspective view of nestable pallet 410 according to the present invention. FIG. 37 is a top plan view of pallet 410. Central member 428 of the fifth embodiment has a rectangular shape with rounded corners, as well as an upright member 442. The remaining members 426 (i.e. corner, side central, and end central members 430, 432, and 433, respectively) are disposed about the perimeter of top deck 412.

Figure 39:
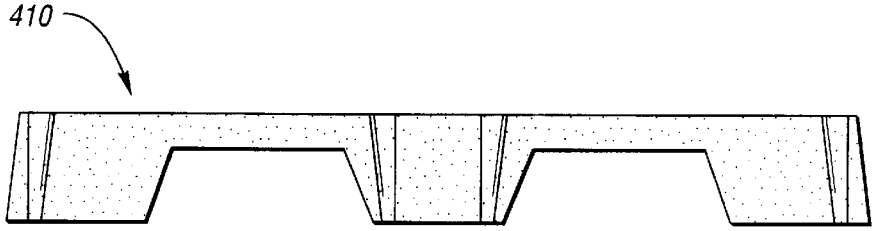
FIG. 39 is a front elevational view of the fifth embodiment.
Figure 40:
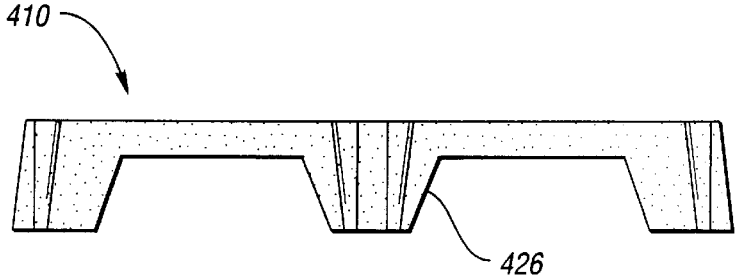
FIG. 40 is a side elevational view of the fifth embodiment.
Figure 38:
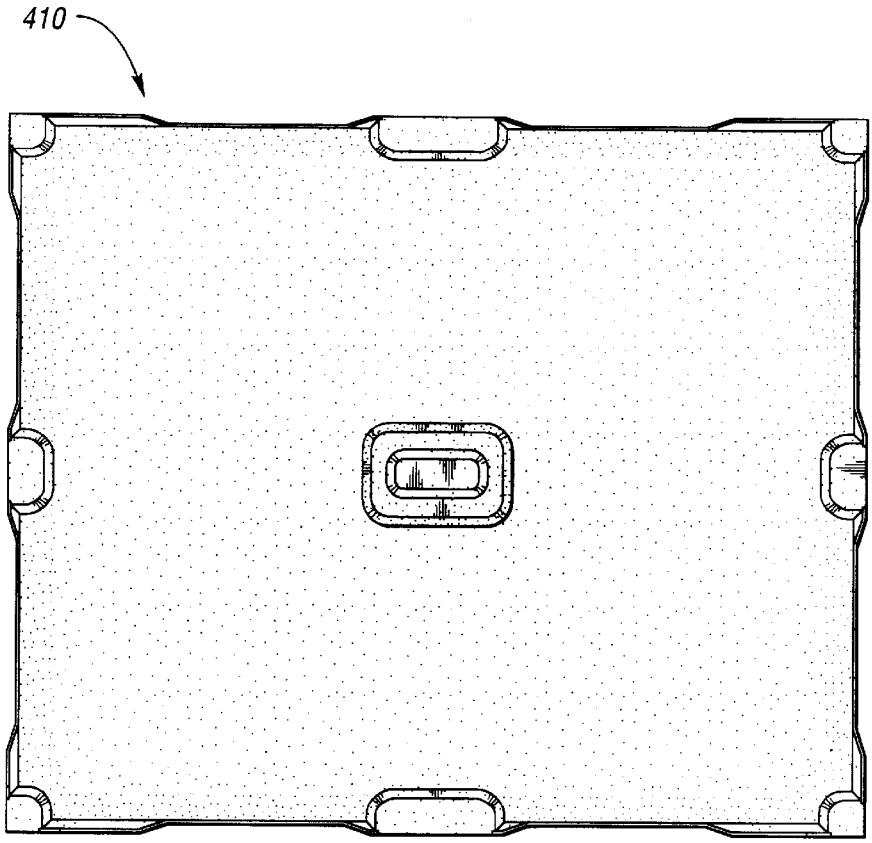
FIG. 38 is a bottom plan view of the fifth embodiment.
Figure 41:
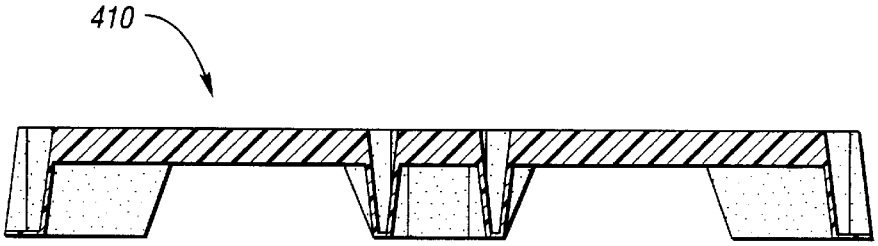
FIG. 41 is a sectional view taken along the line 41—41 of FIG. 37.
Figure 42:
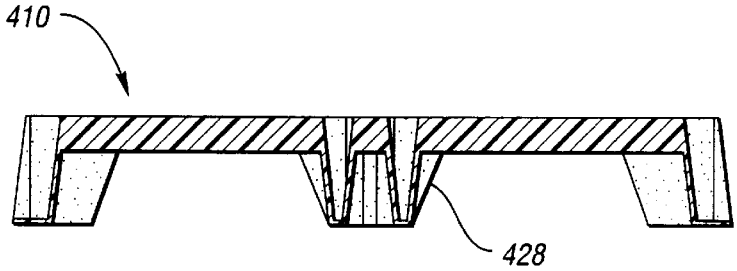
FIG. 42 is a sectional view taken along the line 42—42 of FIG. 37.

Each foot member 430, 432, and 433, has a partial pocket 444 or cutout disposed along the perimeter of top deck 412 for receiving a corresponding member of a like pallet 410 during a nesting orientation. Particularly, cutouts 444 of side and end members 432 and 433 define opposing side walls 418, 420 and opposing end walls 422,424 respectively. FIG. 38 is a bottom plan view of pallet 410. FIG. 39 is a front elevational view of pallet 410. FIG. 40 is a side elevational view of pallet 410. FIG. 41 is a sectional view of pallet 410 taken along the line 41—41 of FIG. 37. FIG. 42 is a sectional view of pallet 310 taken along the line 42—42 of FIG. 37.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet comprising:

a deck portion having an upper surface and at least one opening formed therein; and a foot portion extending from the deck portion and corresponding to the at least one opening, the foot portion having an inner surface, an outer surface, and a plurality of upright members projecting upwardly therefrom, the plurality of upright members including an outer upright member and an inner upright member disposed within the outer upright member, wherein an outer pocket is defined between the inner surface of the foot portion and the outer upright member, and an inner pocket is defined between the outer upright member and the inner upright member, wherein in a nested orientation, each of the inner and outer pockets receives a corresponding foot portion of a like pallet disposed thereabove.

2. The pallet of claim 1, wherein the upper surface of the top deck portion is substantially planar, upon which a plurality of objects are capable of resting.

3. The pallet of claim 1, wherein the plurality of upright members define downwardly directed hollow areas, at least one of which includes at least one nesting stop portion.

4. The pallet of claim 1, wherein at least one of the inner and outer pockets includes at least one aperture for drainage.

5. The pallet of claim 1, wherein at least one of the inner and outer pockets includes at least one nesting stop portion.

6. The pallet of claim 1, wherein the upper surface includes a plurality of apertures for drainage.

7. The pallet of claim 1, wherein each upright member has a hollow area disposed thereunder, wherein in a nesting orientation, each hollow area receives the corresponding upright member of a subjacent like pallet.

8. The pallet of claim 1, wherein each of the upright members have an upper surface substantially co-planar with the upper surface of the deck portion.

9. The pallet of claim 1, wherein each of the upright members has a common axis.

10. The pallet of claim 1, wherein the outer pocket is concentrically disposed about the inner pocket.

11. The pallet of claim 1, wherein the inner pocket is disposed within the upright member and is defined by the inner surface of the upright member.

12. The pallet of claim 1, wherein the inner upright member has a cavity formed therein, the cavity defining a downwardly directed member facing a lower surface of the deck portion, the cavity sufficiently size to receive a corresponding downwardly directed member of a like pallet when in the nested orientation.

13. A nestable pallet comprising:

at least one lower support member having a bottom surface and an inner surface defining a cavity therein, the lower support member further having a first upright member extending from the bottom surface of the support member, the first upright member defining a hollow area thereunder, the lower support member further having a second upright member spaced from the first upright member and defining a second cavity between the first and second upright members; and a planar member having an opening formed therein corresponding to the lower support member, the opening providing entry into the cavity of the support member, wherein in a nested orientation, the hollow area receives a corresponding upright member of a subjacent like nestable pallet.

14. The nestable pallet of claim 13, wherein at least one of the cavities includes at least one aperture for drainage.

15. The nestable pallet of claim 13, wherein at least one of the cavities includes at least one nesting stop portion.

16. The pallet of claim 13, wherein each of the upright members have an upper surface substantially co-planar with the upper surface of the deck portion.

17. The pallet of claim 13, wherein each of the upright members has a common axis.

18. The nestable pallet of claim 13, wherein the first upright member is disposed about the second upright member.

19. A nestable pallet comprising:

a deck member having a plurality of support members extending therefrom, the deck member having an upper surface with a plurality of openings formed therein, each opening corresponding to a one of the plurality of support members, wherein at least one support member includes a plurality of spaced apart pockets therein extending to the upper surface of the deck member, each of the pockets defining a correspondingly shaped downwardly extending portion, and wherein the pockets are separated by an upright member which defines a downwardly directed hollow portion, wherein when in a nested orientation, each pocket is adapted to receive a correspond downwardly extending portion of a like pallet disposed thereabove, and the hollow portion is adapted to receive a corresponding upright member of a like pallet disposed subjacent thereto.

20. The pallet of claim 19, wherein the pockets include an inner pocket and an outer pocket, and wherein the inner pocket is disposed within the upright member and is defined by the inner surface of the upright member.

21. The pallet of claim 19, wherein the pockets include an inner pocket and an outer pocket, and wherein the outer pocket is concentrically disposed about the inner pocket.

22. The pallet of claim 19, wherein the plurality of spaced apart pockets include an inner pocket and an outer pocket, wherein the outer pocket is defined by an inner surface of the support member and an outer surface of the upright member.

23. The pallet of claim 19, wherein each of the pockets has a common axis.

24. The pallet of claim 19, wherein the inner pocket is centrally disposed within the support member.

* * * * *